US005329435A

United States Patent [19]

McGuire

[11] Patent Number: 5,329,435

[45] Date of Patent: Jul. 12, 1994

[54] APPARATUS FOR PRODUCING LIGHT DISTRIBUTIONS

[75] Inventor: Kevin P. McGuire, Rochester, N.Y.

[73] Assignee: Tailored Lighting Company, Inc., Pittsford, N.Y.

[21] Appl. No.: 52,199

[22] Filed: Apr. 22, 1993

Related U.S. Application Data

[63] Continuation-in-part of Ser. No. 10,616, Jan. 28, 1993.

[51] Int. Cl.[5] ..... F21V 9/00

[52] U.S. Cl. ..... 362/293; 359/888; 359/889; 362/2

[58] Field of Search ..... 362/2, 293, 319, 321, 362/324; 359/889, 888

[56] References Cited

U.S. PATENT DOCUMENTS

| | | | |
|---|---|---|---|
| 3,116,022 | 12/1963 | Davis | 362/293 |
| 3,202,070 | 8/1965 | Pratt, Jr. et al. | 362/293 |
| 4,080,050 | 3/1978 | Huber | 359/889 |
| 4,811,182 | 3/1989 | Solomon | 362/293 |
| 4,890,208 | 12/1989 | Izenour | 362/293 |
| 5,079,683 | 1/1992 | McGuire | 362/293 |
| 5,083,252 | 1/1992 | McGuire | 362/2 |
| 5,210,657 | 5/1993 | Komazawa et al. | 362/293 |

*Primary Examiner*—Carroll B. Dority
*Attorney, Agent, or Firm*—Howard J. Greenwald

[57] ABSTRACT

An apparatus for generating a spectral distribution. This apparatus contains a light source and a single filter. The single filter is comprised of a color correcting filter material and a neutral density filter material. When the apparatus is adjusted, the spectral distribution of the light which passes through it varies continuously, but the brightness and/or irradiance of such light is substantially constant.

14 Claims, 18 Drawing Sheets

APPARATUS FOR PRODUCING LIGHT DISTRIBUTIONS

REFERENCE TO RELATED PATENT APPLICATION

This application is a continuation-in-part of applicant's copending patent application U.S. Ser. No. 08/010,616, filed on Jan. 28, 1993.

FIELD OF THE INVENTION

An apparatus which can produce any specified light distribution such as, e.g., daylight, room light, sky light, monochromatic light, and the like.

BACKGROUND OF THE INVENTION

Many attempts have been made to simulate natural daylight by artificial means. It has been claimed, with some justification, that natural daylight is the preferred lighted environment. Thus, for example, in form 01128809L 150M (1990), the Duro-Test Corporation (of 9 Law Drive, Fairfield, N.J.) states that a good simulation of natural daylight " . . . encourages people to perform as never before because it promotes good vision . . . People see better and work better . . . " Thus, in form 0090 (1988), the Duro-Test Corporation states that light which " . . . simulates natural daylight . . . " is " . . . the perfect interior lighted environment . . . ."

One of the recognized experts on the use of color and its effects on people, Mr. Carlton Wagner, has published a book entitled "Beyond Beautiful" (The Wagner Institute for Color Research, Santa Barbara, Calif., 1990). At page 38 of this book, he recommends that, when women are evaluating the colors of objects, they should "arrange them . . . artificial means. It has been claimed, with some under a good light source (daylight or bright incandescent lighting is best . . . ").

The standard spectrum for daylight is referred to in D. L. MacAdam's "Color Measurement: Theme and Variations" (Springer-Verlag, N.Y., 1981.) In this book, the author refers to the CIE's D65 illuminant.

It is desirable to be able to simulate other daylight spectra, besides the D65 spectra. Thus, as is well known to those skilled in the art, the spectra of daylight will vary depending upon the daylight, upon atmospheric conditions, and solar altitude; see, e.g., S. T. Henderson's "Daylight and Its Spectrum," Second Edition (John Wiley & Sons, New York, 1977).

There are devices known to the prior art which are capable of generating different spectral distributions; see, e.g., the device disclosed in German patent 1,744,824 of Karl. However, as the spectra generated by these devices change, the intensity of such spectra changes.

For many applications, it is desirable that a sample be viewed under different spectral distributions at a substantially constant irradiance. Thus, for example, A.S.T.M. Standard D-1729-60T, entitled "Visual Evaluation of Color Differences in Opaque Materials," is often used for color matching of painted surfaces. The A.S.T.M. Standard requires that a specified opaque surface is to be viewed under different spectral conditions and that the irradiance of each of such condition be substantially constant. Thus, in section 5.1.2 of the Standard, it is provided that "For critical evaluation of color differences of materials of medium lightness, the illumination at the center of the viewed area shall be 100 to 125 foot-candles . . . In viewing very light materials, the illumination may be reduced to as low as 50 foot candles . . . and for the very dark materials may be increased to as much as 200 foot candles . . . "

The device of the Karl patent is not capable of producing different spectral distributions at a substantially constant level of irradiance.

The prior art repeatedly suggests that, although different spectral distributions may be produced from a single light source and a multiplicity of filters, such distributions will have substantially different irradiances. Thus the "Kodak Color Darkroom Dataguide" (published by the Photographic Products Group, Eastman Kodak Company, Rochester, N.Y. 14650) discusses the adjustment one must make when developing prints using a single light source and different filters. At page 48 of this dataguide, in a paragraph entitled "Exposure Adjustments for Filter-Pack Changes," it is taught that "The overall density of a print is affected by changes in the number and density of the filters in the filter pack . . . For example, if you add 10M to the filter pack. increase exposure by 10 percent." The filter pack referred to in this quotation is mentioned at page 39 of the dataguide, in a paragraph entitled "Kodak Color Printing (CP) Filters" which states that "You place these acetate filters between the light source and the negative . . . When you change the filter pack, you can calculate adjustments from the filter factors for the filters you add or remove."

Not everyone who uses darkroom apparatus has both the expertise, the time, and the patience to calculate correction factors for the differing spectral distributions which must be used to correctly expose a photographic print. Not everyone who uses color matching apparatus realizes the importance of viewing the objects with spectra which have substantially constant irradiances.

In applicant's U.S. Pat. No. 5,079,683, an apparatus is provided which is able to automatically make the adjustments suggested in the Eastern Kodak dataguide. However, the device of this patent is relatively large, must contain a several fans to cool the optical components, and contains a a relatively large and expensive filter extrusion device. Furthermore, the device of this patent is not readily able to illuminate a large area. Because of these factors, this device also is relatively expensive to manufacture and its markets are limited.

It is an object of this invention to provide an apparatus which is as useful in every respect as the device disclosed in U.S. Pat. No. 5,079,683 (the disclosure of which is hereby incorporated by reference into this specification) but which, additionally, is less expensive to produce, less cumbersome, does not require as much cooling, and produces both more illumination and a broader area of illumination.

It is another object of this invention to provide an apparatus which will allow a user to produce spectra in which either the intensity is varied and/or the spectral content is varied.

It is yet another object of this invention to provide an apparatus is relatively lightweight, simple, and economical to produce.

SUMMARY OF THE INVENTION

In accordance with this invention, there is provided an apparatus for generating a spectral distribution. This apparatus contains a light source and a single filter. The single filter is comprised of a color correcting filter. In one embodiment, when the apparatus is adjusted, the spectral distribution of the light which passes through it varies continuously, but the brightness and/or irradiance of such light is substantially constant.

DESCRIPTION OF THE DRAWINGS

The present invention will be more fully understood by reference to the following detailed description thereof, when read in conjunction with the attached drawings, wherein like reference numerals refer to like elements and wherein.

DESCRIPTION OF THE PREFERRED EMBODIMENTS

The first part of this specification will describe the embodiment of applicant's invention which also is described in U.S. Pat. No. 5,079,683 and his copending patent application U.S. Ser. No. 08/010,616. Much of this description, however, will be applicable to the invention described in the second part of this specification, and it is believed that the description of the prior device will assist those in the art in understanding how the new device works.

Figure 1:
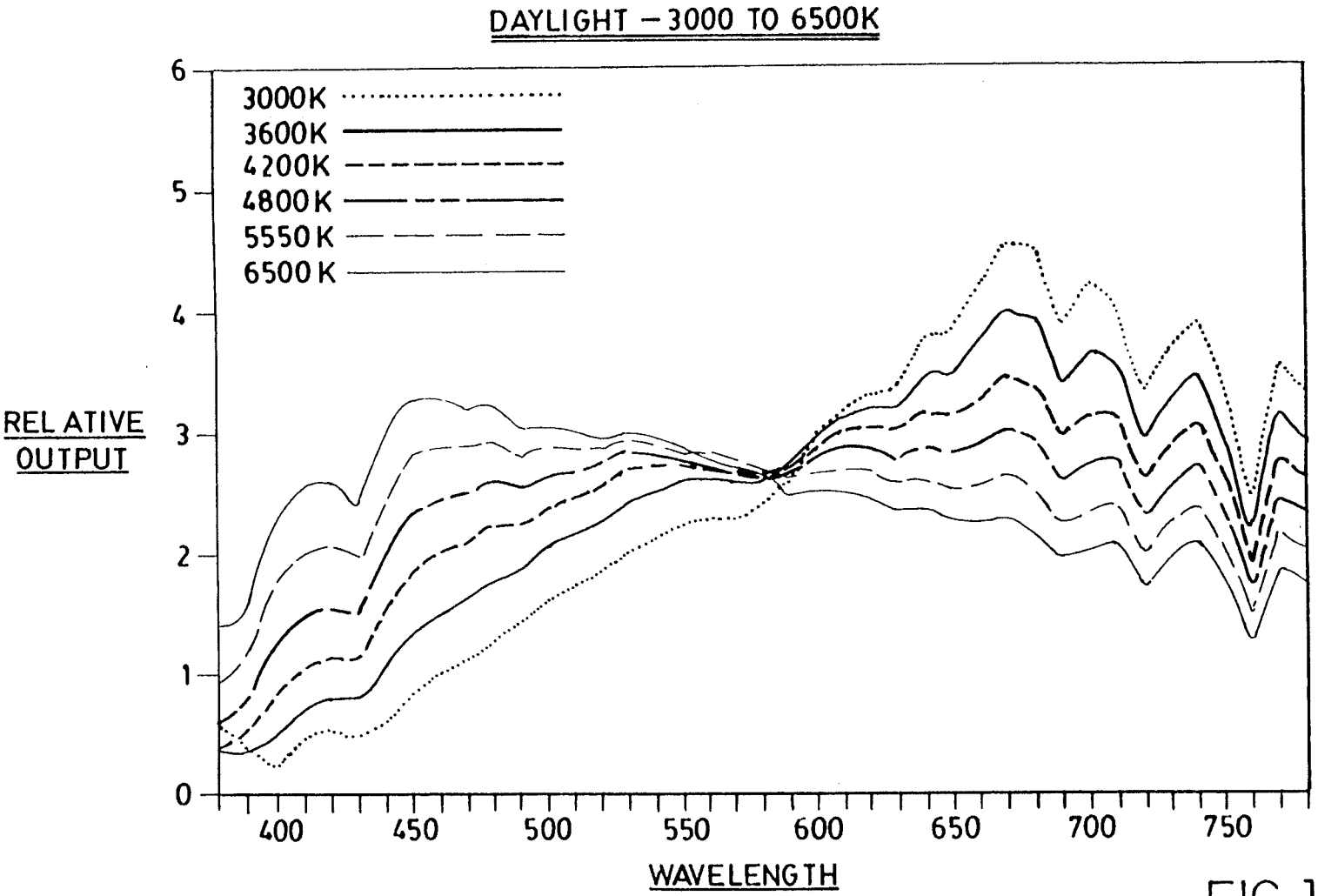
FIG. 1 is a graph of the spectral distribution of multiple daylight conditions of constant irradiance from 380 to 780 nanometers.

FIG. 1 contains several graphs of spectral distributions of daylight, over the range of wavelengths of from about 380 to 780 nanometers. It should be noted that, although each spectral distribution has a different range of relative outputs, the irradiance of each of such spectral distributions is equal.

Referring to FIG. 1, it will be seen that each spectral distribution plot corresponds to a light output with a specified color temperature. Thus, for example, the solid line plot corresponds to a daylight spectral distribution with a color temperature of 6,500 degrees Kelvin. At the other extreme, the dotted line plot corresponds to a daylight spectral distribution with a color temperature of 3,000 degrees Kelvin. These plots are merely illustrative and not limitative; it should be understood that daylight spectral distributions can have color temperatures less than 3,000 degrees Kelvin and greater than 6500 degrees Kelvin.

As used in this specification, the term color temperature refers to the temperature of a black body which has the same chromaticity as the test source.

For any given wavelength, the relative output of each daylight spectral distribution is plotted. The total integrated output of such spectral distribution is its irradiance. The irradiance is the radiant flux incident per unit area of a surface. Radiant flux is the rate at which radiant energy is transferred from one region to another by the radiation field.

The graph of FIG. 1 may be generated by measuring the individual irradiance of each of the daylight spectral distributions over the range of 380 to 780 nanometers.

Thereafter, by conventional means, the plots of the relative outputs of the different daylight spectral distributions may be generated.

The area defined by the plot of any of the spectral distributions will be equal to the area defined by the plot of any of the other spectral distributions; these areas may be calculated by conventional integration techniques.

Figure 2:
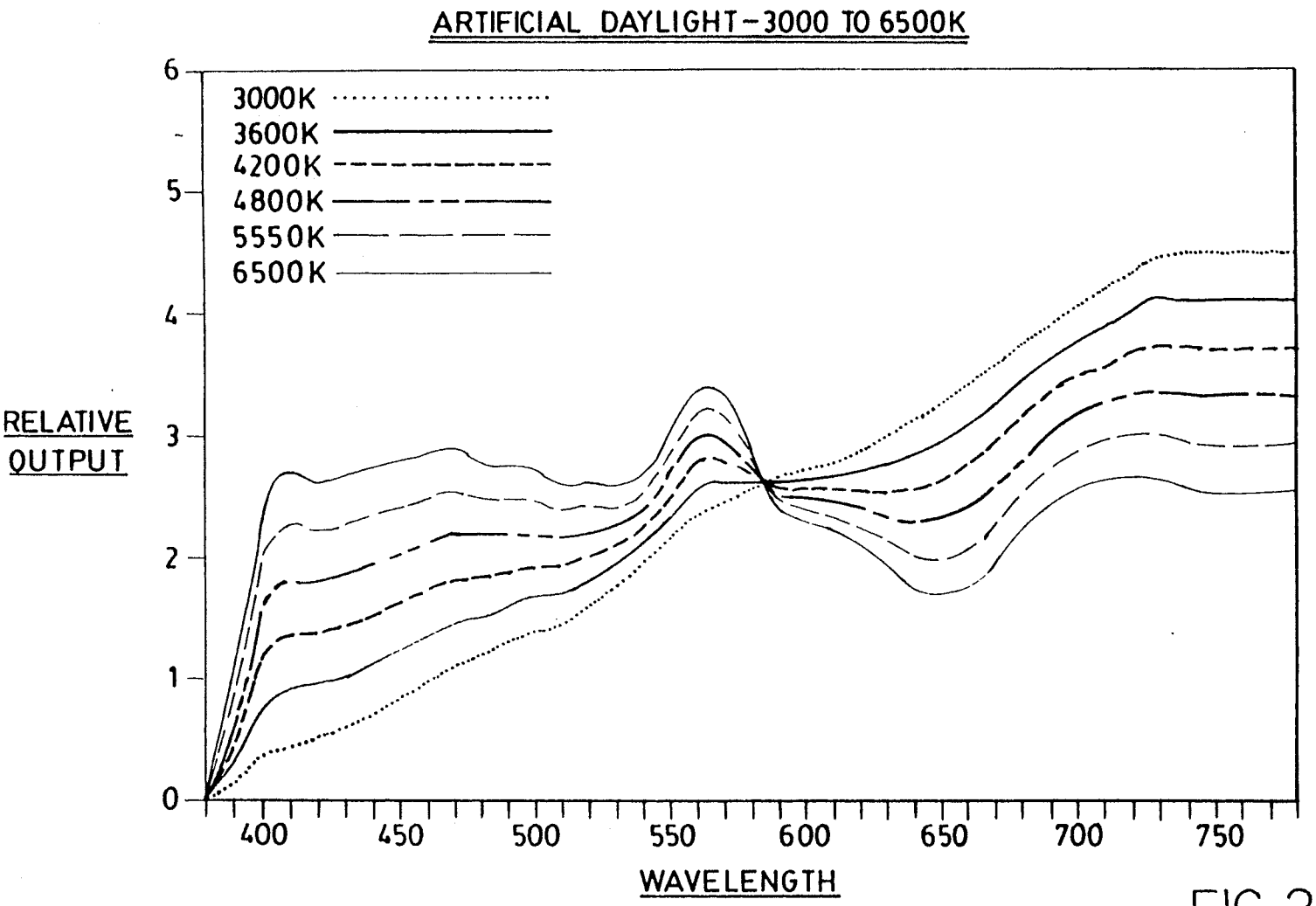
FIG. 2 is a graph of multiple simulated daylight spectral distributions of constant irradiance from 380 to 780 nanometers.

Referring to FIG. 2, similar plots of spectral distributions with various color temperatures which may be produced by applicant's apparatus are shown. It should be noted that, like the spectral distributions of FIG. 1, each of the spectral distributions of FIG. 2 had an area defined by its plot which is equal to the area defined by the plot of any of the other spectral distributions of FIG. 2 and/or FIG. 1. Thus, applicant's apparatus is capable of changing the spectral distribution of its light output while maintaining the irradiance of such output at a substantially constant level.

Although FIGS. 1 and 2 describe the irradiance of spectral distributions which differ in their color temperatures, it should be understood that applicant's apparatus is capable of producing spectral distributions which differ in other respects (such as minus red characteristics, etc.) but still have substantially the same irradiance. In one embodiment, described elsewhere in this specification, the apparatus capable of providing outputs which differ in irradiance but have substantially the same spectral output.

In one preferred embodiment, described below, applicant's apparatus is able to continuously produce different spectral distributions with the same irradiance with only one mechanical control means. By moving one lever or control knob in his device, applicant is able to produce an infinite number of spectral distributions from a given light source; each of the distributions so produced, however, have the same irradiance.

Referring to FIG. 1, a view of applicant's light generating apparatus 10 is shown. Light generating apparatus 10 is comprised of case 12.

Case 12 of light generating apparatus 10 may be constructed in any conventional manner of conventional material. It may be constructed from metal, plastic, glass, and the like. In one preferred embodiment, case 12 is constructed of sheet metal.

Case 12 defines a substantially U-shaped interior portion which comprises a hood 16, a lamp housing 18, and a base 20. The hood 16 is designed to minimize the amount of ambient light which contacts base 20. It is preferred that at least 96 percent of ambient light which contacts apparatus 10 is shielded from base 20.

In one preferred embodiment, base 20 has a "gray paint" appearance, as defined by section 5.1.5.3. of the aforementioned A.S.T.M. Standard D-1729. This "gray paint" surface provides a gloss which is no greater than 15 on the 60-degree gloss scale (see A.T.S.M. Standard Test D523, "Specular Gloss").

Figure 3:
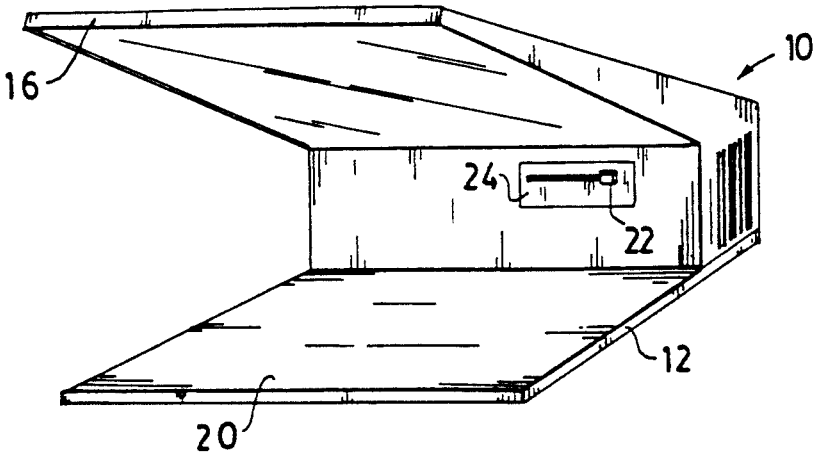
FIG. 3 is a perspective view of one embodiment of applicant's invention.
Figure 4:
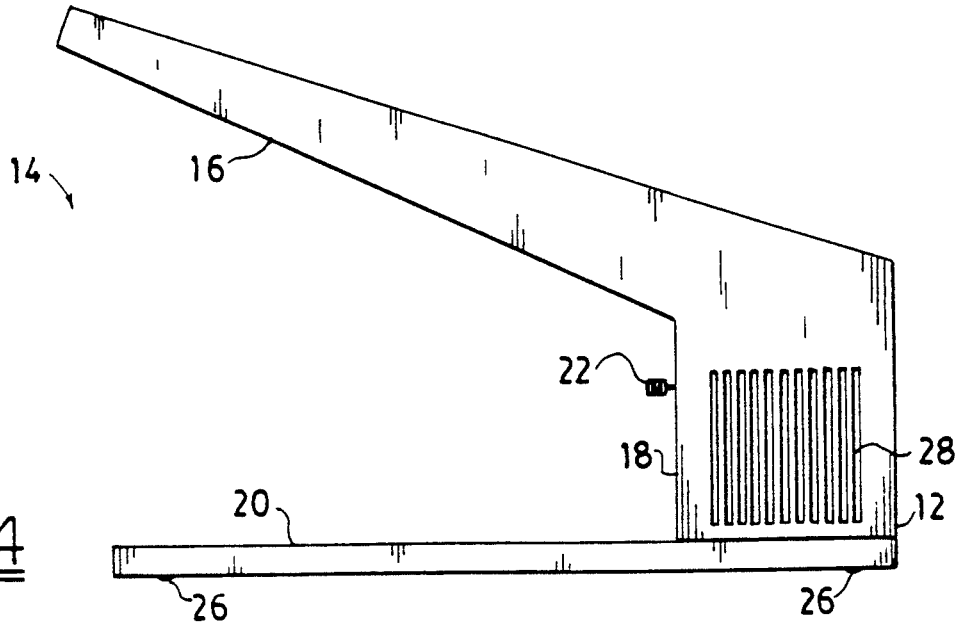
FIG. 4 is a side view of the embodiment of FIG. 3.
Figure 5:
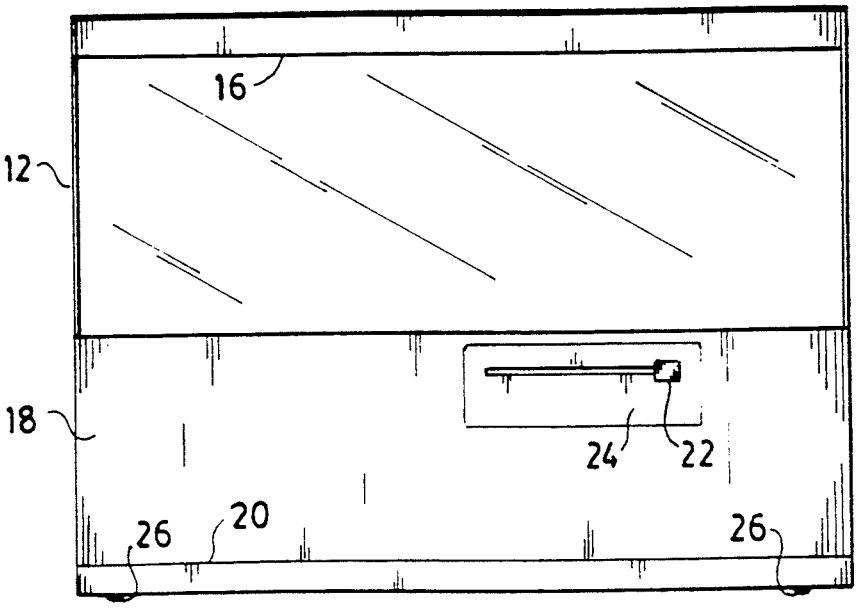
FIG. 5 is a front view of the embodiment of FIG. 3.

In the preferred embodiments illustrated in FIGS. 3, 4, and 5, apparatus 10 is comprised of a control knob 22. By the use of this simple control knob, the spectral output of apparatus 10 may be varied while simultaneously maintaining the irradiance of such output at a constant level.

In the embodiment illustrated in FIG. 5, the control knob 22 is mounted in front of a template 24. As this knob is moved, it simultaneously varies the spectral characteristics of the light omitted from the hood 16 and indicates, by its possible position vis-a-vis template 24, what the spectral characteristics of such light are.

In the preferred embodiment illustrated in FIGS. 4 and 5, base 20 is attached to lamp housing 18 and hood 16 by a multiplicity of fasteners (not shown). The base 20 is preferably mounted on rubber feet 26 in order to minimize the amount of vibration transmitted to apparatus 10.

It is preferred that apparatus 10 comprise air vents, such as vents 28 (see FIG. 4) to allow air to flow in and out of apparatus 10. These air vents 28 may be formed in housing 18 by conventional means such as, e.g., by punching them out of the sheet metal, by lancing them, by louvering them, etc.

Figure 6:
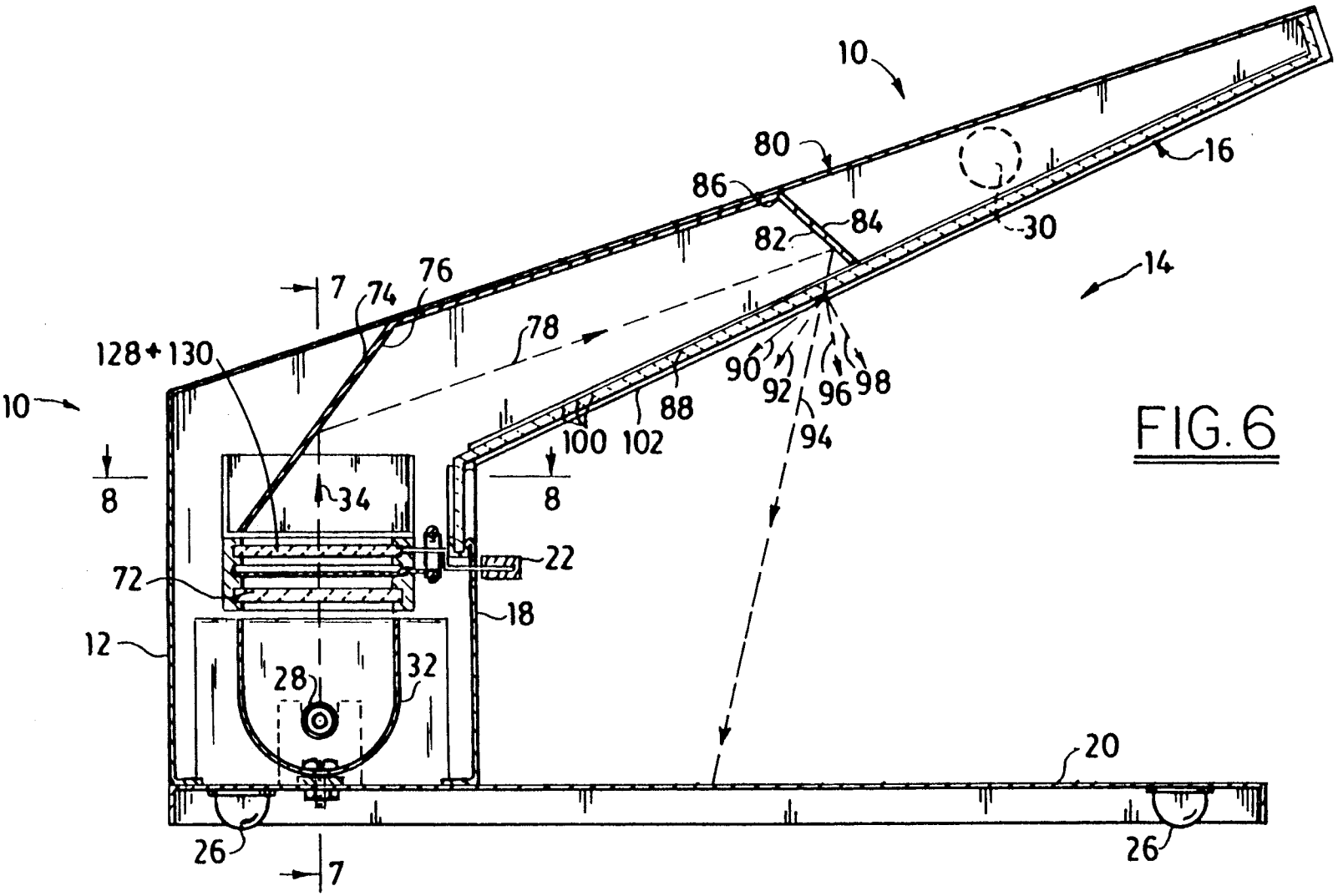
FIG. 6 is a side sectional view of the embodiment of FIG. 3.

FIG. 6 is a sectional view of the embodiment of FIG. 5 Referring to FIG. 6, it will been seen that apparatus 10 is comprised of the light source 28.

Light source 28 may be any light source which provides a full spectrum of light. As used in this specification, the term full spectrum of light is a spectrum which contains no voids. Thus, when a plot of the spectrum (in watts versus wavelengths) is made, such plot will be a continuous line above the abscissa for a continuous spectrum of light.

Light source 28 is operatively connected to a power supply (not shown) which, preferably, delivers alternating current to the light source.

In one embodiment , apparatus 10 is also comprised of a second light source, light source 30 which provides a spectrum of light from about 10 nanometers to about 380 nanometers, thus providing light in the ultraviolet spectrum. In the same embodiment, the light source 28 preferably provides a continuous spectrum of light from about 380 to 780 nanometers, providing visible light.

In one embodiment, an incandescent lamp which radiates energy at wavelengths between 380 nanometers to 1,000,000 nanometers is used as light source 28. Such a lamp is described in pages 55–59 of Volume 7 of McGraw-Hill Encyclopedia of Science and Technology (McGraw-Hill Book Company, N.Y., 1977).

In another embodiment, a hydrogen lamp (also known as a deuterium lamp) which radiates energy at wavelengths between about 10 to about 380 nanometers may be used.

One may use any of the radiation sources known to those skilled in the art of light source 28. Thus, by way of illustration and not limitation, one may use any of the light sources described in U.S. Pat. No. 4,536,832 of Lemmons such as, e.g., the HMI metal halide lamp, the CSI metal halide lamp, the CID metal halide lamp, the carbon arc lamp, the mercury arc lamp, the xenon arc lamp, and the like. Thus, e.g., one may use fluorescent lamps. Thus, e.g., one may use the light sources described in U.S. Pat. No. 1,845,214 of Arrousez, U.S. Pat. No. 3,379,868 of Richardson, U.S. Pat. No. 2,057,278 of Richardson, and German Utility Model No. 1,744,824. The disclosure of each of said U.S. Patents and of said German patent is hereby incorporated by reference into this specification.

Light source 28 may be comprised of only one lamp. Alternatively, light source 28 may be comprised of at least two lamps, each of which radiates a different light spectrum. In yet another embodiment, light source 28 is comprised of at least three lamps, each of which radiates a different light spectrum.

In another embodiment, only one lamp is used as light source 28 and it is a tungsten halogen lamp. These lamps are well known to those skilled in the art. Thus, for example, illuminant produced by these lamps (known as CIE illuminant A) is described on page 30 of D. L. MacAdam's "Color Measurement: Theme and Variation" (Springer-Verlag, N.Y., 1981). One preferred tungsten-halogen lamp is Sylvania's ANSI code FCL 58856, which is rated at 120 volts, has a color temperature of 3,000 degrees Kelvin, produces 10,000 lumens, and has filament class C8. Another preferred FCL lamp is a General Electric's "WATT-MISER QUARTZLINE" lamp, which contains an envelope around the filament which has an infrared reflective coating and reflects the infrared radiation back onto the filament, thereby reducing the energy required. One preferred bulb which might be used in the General Electric lamp is General Electric's Q500/350WM bulb.

It is preferred that light source 28 have a substantially constant output over its period of use; for every frequency, the output should be better than within 0.1 percent of the initial value.

It is preferred that light source 28 be enveloped by a clear envelope rather than one which has a diffused surface.

Light source 28 is disposed near light reflecting element 32, which reflects the light rays from light source 28 upward in the direction of arrow 34.

In one embodiment, the light reflecting element 32 is a aluminum-coated reflector. Any aluminum-coated reflector 32 known to those skilled in the art may be used. Thus, by way of illustration and not limitation, one may use the reflectors described in William's B. Elmer's "The Optical Design of Reflectors," Second Edition (John Wiley and Sons, New York, 1980), the disclosure of which is hereby incorporated by reference into this specification. It is preferred that the reflector used be circular with a radius of about 1.0 inch and have sidewalls extending upwardly about 1.0 inch.

In one preferred embodiment, light reflecting element 32 consists essentially of annealed stainless steel and has a thickness of from about 0.050" to about 0.070".

It is preferred that the interior surface of light reflecting element 32 be sufficiently flat so that the angle between a reflected ray and the reflecting surface is equal and opposite to the angle of incident ray. The flatness of such interior may be measured by means well known to those skilled in the art. Thus, in one preferred embodiment, the interior surface of reflector 32 is a specular surface.

In one preferred embodiment, it is preferred that the interior surface of the light reflecting element 32 be constructed of a material which preferentially transmits the infrared portion of the light spectrum while reflecting the visible portion of such light spectrum. As is known to those skilled in the art, such a material is commonly used to make a "cold mirror" such as those which are discussed on page 1117 of the aforementioned "Optics Guide 5."

In one embodiment, the interior surface of light reflecting element 32 is constructed of a metal (such as, e.g., aluminum) which contains randomized, spherical impressions in its surface to provide an irregular reflection pattern and to reduce "hot spots" caused by the light source. Such a material is commercially available and is sold, e.g., as "RIGIDTEX" by the Rigidized Metal Corporation of 658 Ohio Street, Buffalo, N.Y.

The term specular surface, as used in this specification, refers to a microscopically smooth and mirror like surface without any noticeable diffusion. See, for example, pages 25–26 of said Elmer book.

In one embodiment, light source 28 is so disposed in reflector 32 that a focused or partially focused beam of light 34 is directed toward filters 128 and 130. The focusing, or partial focusing, of light beam 34 allows one to minimize the size of filters 128 and 130.

Figure 7:
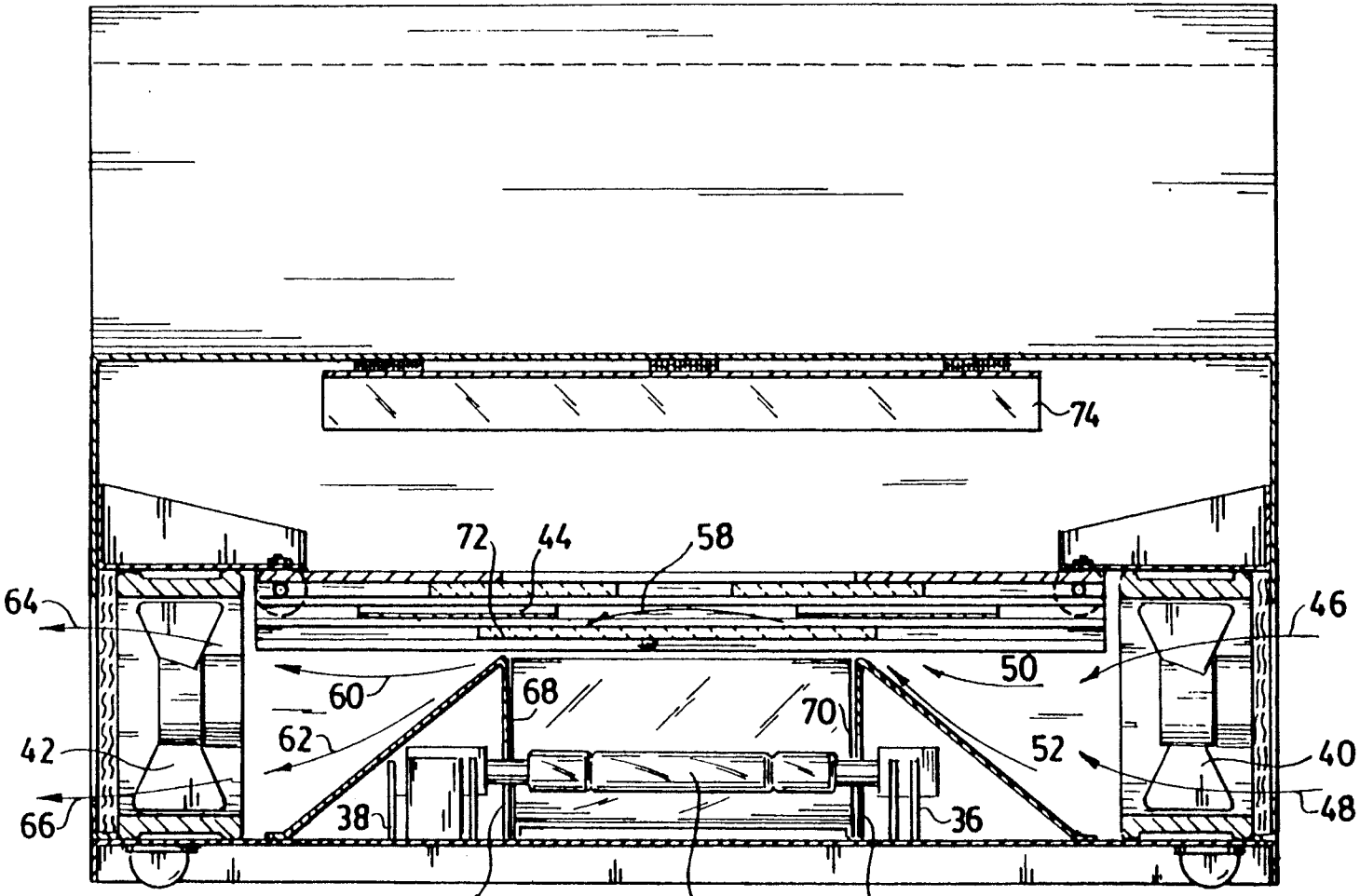
FIG. 7 is a front sectional view of the embodiment of FIG. 3.

FIG. 7 is a partial sectional view of the front of applicant's preferred apparatus of FIG. 6, taken along lines 7—7. Referring to FIG. 7, the light source 28 is captured by sockets 36 and 38.

Referring again to FIG. 7, it is preferred that light generating apparatus 10 also comprise fans 40 and 42.

These fans preferably blow air across filter extrusion 44 to keep the optics housed by it cool. The air preferably flows in the direction of arrows 46 and 48; it contacts inverted V-shaped reflectors 54 and 56 and thereby flows in the direction of arrows 58, 60, 62, 64, and 66. Furthermore, in addition to directing the flow of air, the inverted V-shaped members 54 and 56 also function as does reflector 32. One of the primary function of reflector 32 is to assist in the mixing of filtered and unfiltered light in hood 16.

It is preferred that V-shaped members 54 and 56 each contain at least one specular surface. In the preferred embodiment illustrated in FIG. 7, each of said V-shaped members contains such specular surface on its surface closest to light source 28. Thus, interior surface 68 of V-shaped member 56 is specular, as is interior surface 70 of V-shaped member 54.

The polychromatic light rays from lamp 28 are preferably caused to impinge upon heat reflecting means 72. The function of heat reflecting means 72 is to reflect the infrared radiation generated by light sources 28 downward back toward said light source. As known to those skilled in the art, such infrared radiation generally has a wavelength of from about 780 to about 1,000,000 nanometers. Thus, the light passing through heat reflecting means 72 will preferably have a wavelength of from about 380 to about 780 nanometers.

Any means well known to those skilled in the art may be used to remove the infrared radiation from the light. Thus, by way of illustration, one may use an optical glass filter. One suitable optical glass filter is a IRR Pyrex glass filter (sold by the F. J. Gray Company, 139-24 Queens Blvd., Jamaica, N.Y. 11435).

In the preferred embodiment illustrated in FIG. 7, the heat reflecting means 72 is preferably mounted in the filter extrusion 44.

Referring again to FIG. 6, light from light source 28 is guided by reflector 32, and by surfaces 68 and 70 (seen FIG. 7) upwardly in the direction of arrow 34, whereby it impinges upon reflector 74. The interior surface 76 of reflector 74 preferably has the same reflective characteristics as do the surfaces of reflectors 32, 68, and 70, i.e., such surface 76 is preferably specular.

Reflector 74 is disposed within hood 16 in such a manner that light ray 78 reflected from the surface 76 of reflector 74 is directly approximately parallel to top surface 80 of hood 16 and thereby impinges upon the interior surface 82 of reflector 84. Interior surface 82 of reflector 84 also preferably is specular.

Reflector 84 is movable, being hingably attached to surface 80 of hood 16 at point 86. A external lever (not shown) may be attached to reflector 84 to vary the angle of reflection of light ray 78. Thus, referring again to FIG. 6, the light ray 78 may be caused to exist through orifice 88 of hood 16 in any of directions 90, 92, 94, 96, 98, and the like.

In another embodiment, not shown, reflector 74 is so disposed within hood 16 that light ray 78 is caused to impinge upon multiple reflective blades 100. These reflective blades are adjustably and hingably attached to surface 102 of hood 16 so that the light reflected from them may be directed in a multiplicity of different directions, such as directions 90, 92, 94, 96, and 98. In this embodiment, it is preferred that reflective blades be disposed along the entire length of surface 102. It is preferred that the surfaces of these reflective blades 100 be specular.

In one preferred embodiment, surface 102 is comprised of acrylic material which, preferably, has a diamond-patterned surface impregnated into it.

Figure 8:
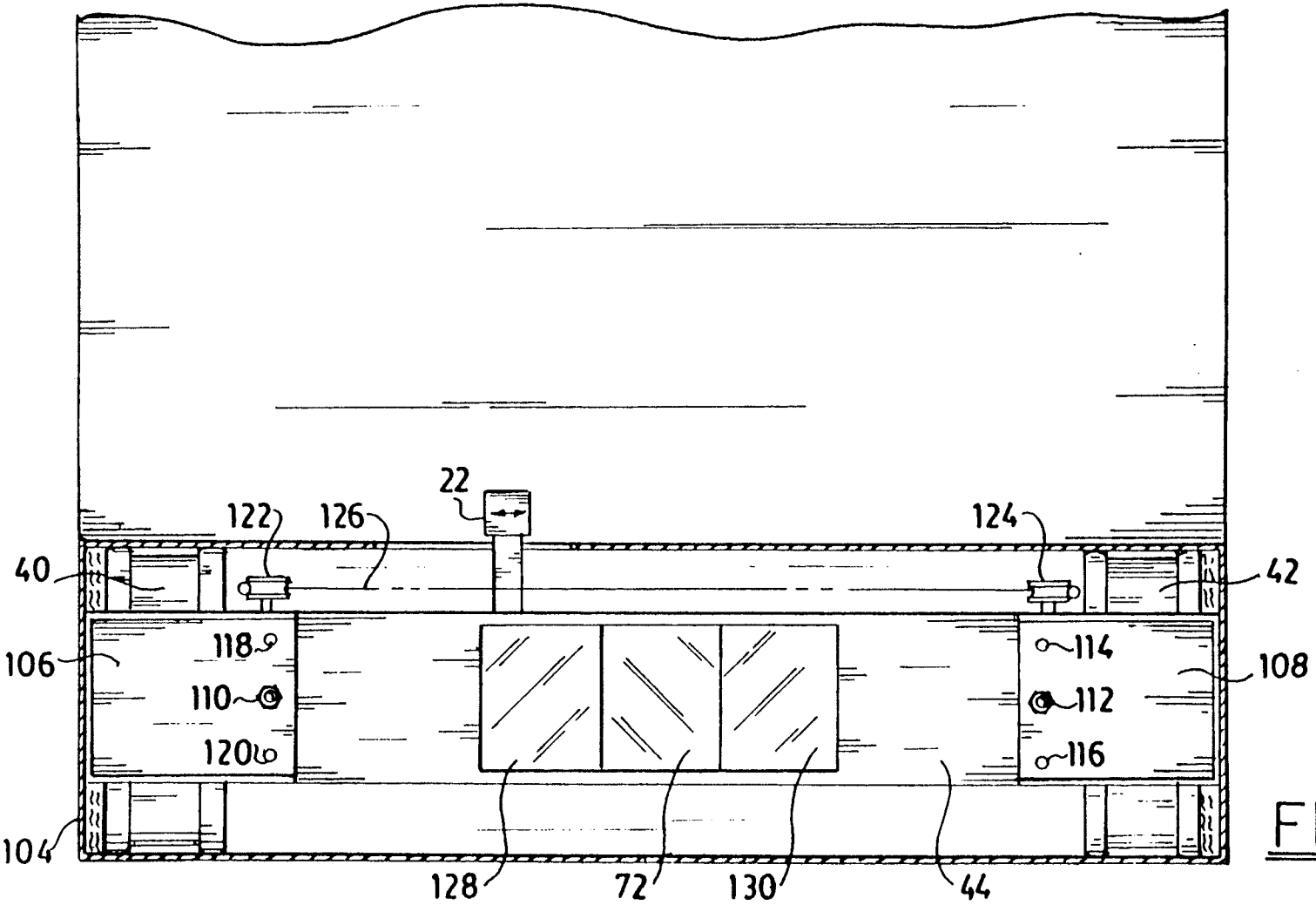
FIG. 8 is a top view of a filter extrusion used in the embodiment of FIG. 3.

FIG. 8 is a partial sectional view of the top of the apparatus of FIG. 6, taken along lines 8—8. Referring to FIG. 8, it will be seen that, in this embodiment, filter extrusion assembly 44 is attached to hood surface 104 by brackets 106 and 108.

It is preferred to attach brackets 106 and 108 to surface 104 by conventional means. Thus, said brackets 106 and 108 may be welded to surface 104.

Extrusion assembly 44 may be attached to brackets 106 and 108 by conventional means. Thus, by way of illustration, and referring to FIG. 8, they may also be attached by bolts 110 and 112 and corresponding nuts. Furthermore, as indicated in FIG. 8, they may also be aligned by tabs 114, 116, 118, and 120.

Referring again to FIG. 8, it will be seen that control knob is operatively connected to pulleys 122 and 124 by cable 126; and movement of the control knob in a left or right direction results in rotation of said pulleys 122 and 124. Furthermore, control knob 22 is also directly connected to filter 128 and thereby moves said filter in a corresponding left or right direction.

Filter 130 is movably attached to filter 128 through cable 126. and it moves in a direction opposite to that of filter 128. Thus, when filter 128 moves left, filter 130 moves right.

It will be apparent to those skilled in the art that applicant's device 10 is relatively uncomplicated and inexpensive. It is preferred that the filter assembly in be one that is an unmotorized, opto-mechanical apparatus, as distinguished from the motorized, electro-optomechanical device of the aforementioned Eastman Kodak Company patent.

The filter assembly in applicant's device is preferably unmotorized. As is known to those skilled in the art, a motorized device is one that is equipped with a motor, i.e., a device which imparts or produces mechanical motion through, e.g., the conversion of electrical energy into mechanical energy.

Applicant's device is comprised of an adjustable, optomechanical filter assembly which is unmotorized and neither contains nor requires an electrical circuit. This simplicity and versatility of this opto-mechanical filter means allows for the simplicity and versatility of applicant's device.

Figures 9, 10, 11:
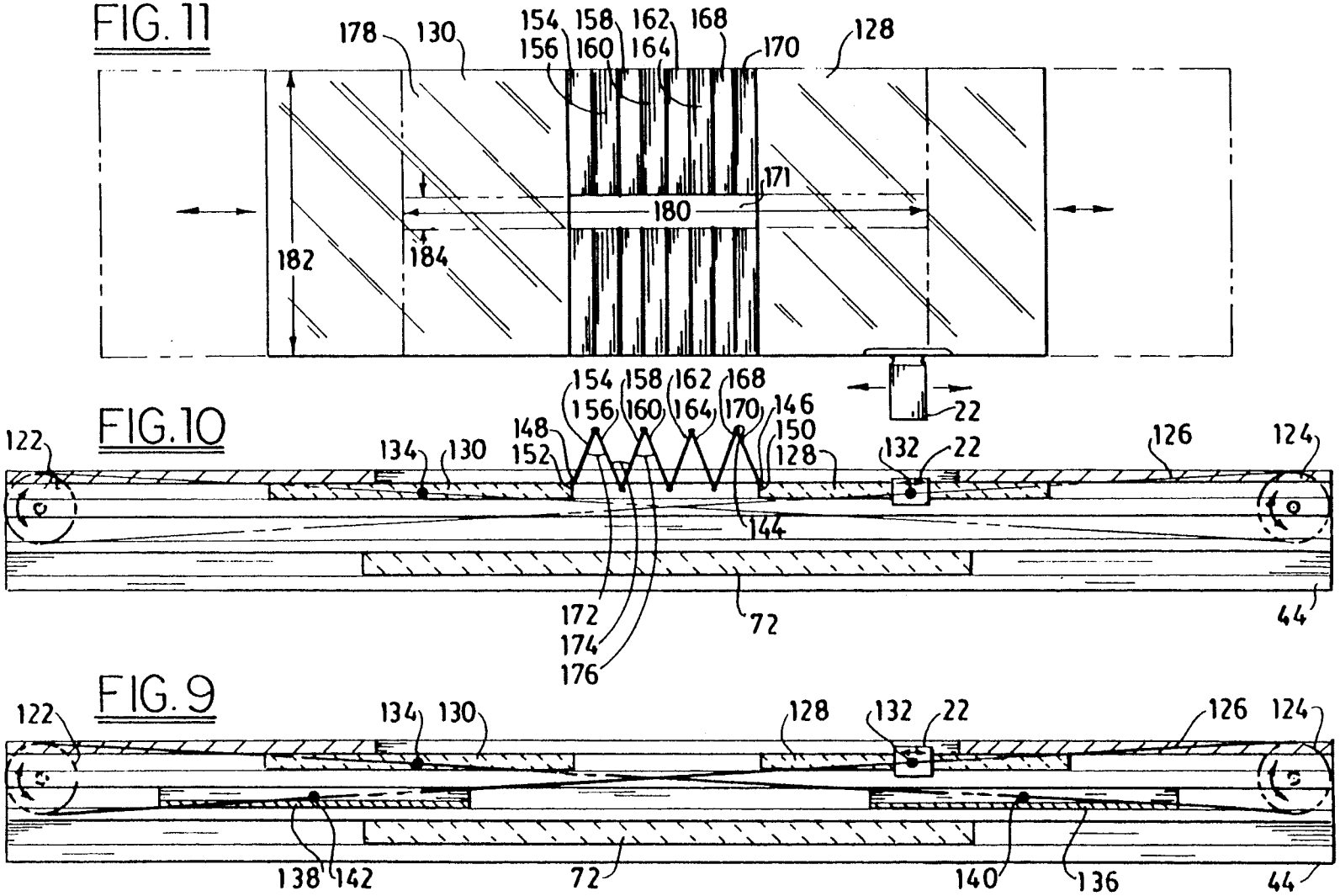
FIG. 9 is a side view of a filter extrusion similar to that depicted in FIG. 8.
FIG. 10 is a side view of another filter extrusion similar to that depicted in FIG. 8.
FIG. 11 is a top view of the filter extrusion of FIG. 10.

FIG. 9 illustrates one embodiment of a filter assembly which is capable of producing different spectral distributions and which, at its two extremes, produces spectral distributions with substantially constant irradiance.

The embodiment of FIG. 9 is similar to the embodiment of FIG. 8. Thus, like the latter embodiment, the embodiment of FIG. 9 is comprised of pulleys 122 and 124 which are connected by cable 126 to control knob 22. Control knob 22 is also directly connected to filter 128. Thus, when control knob 22 is moved in a left or right direction, it causes cable 126 to move, filter 128 to move in a left or right direction, and pulleys 122 and 124 to rotate in a counterclockwise and clockwise direction.

The cable 126 is disposed within the extrusion assembly 44 in the shape of a "FIG. 8." As is shown in FIG. 9, both filters 128 and 130 are attached to cable 126 at the top portion of the "FIG. 8," points 132 and 134. Thus, movement of control knob 22 moves both the filter 128, the cable 126, and as a result of the cable's motion, also moves filter 130, pulley 122, and pulley 124. Furthermore, as described below, the movement of the control knob also moves shutters 136 and 138.

Referring again to FIG. 9, it will be seen that the shutters 136 and 138 are attached at the bottom of the "FIG. 8," at points 140 and 142. Because they are attached at the bottom of the "FIG. 8," when the filters 128 and 130 move inwardly, the shutters 136 and 138 move outwardly, and vice versa.

In the embodiment of FIG. 8, infrared filter 72 is stationary. Thus, by moving the control knob 22, one automatically varies the amount of light allowed in by the shutters, and the amount of light affected by the filters.

The embodiment of FIG. 10 is similar to the embodiment of FIG. 9, but it is substantially superior: unlike the embodiment of FIG. 9, each and every spectral distribution which is produced by the embodiment of FIG. 10 has substantially the same irradiance.

Like the embodiment of FIG. 9, the embodiment of FIG. 10 is comprised of pulleys 122 and 124 which are connected by cable 126 to control knob 22. Control knob 22 is also directly connected to filter 128. Thus, when the control knob 22 is moved in a left or right direction, it causes cable 126 to move, filter 128 to move in a left or right direction, and pulleys 122 and 124 to rotate in a counter-clockwise and clockwise direction.

The cable 126 is in the form of a "FIG. 8." As is shown in FIG. 10, both filters 128 and 130 are attached to cable 126 at the top portion of the "FIG. 8," points 132 and 134. Thus, movement of control knob 22 moves both the filter 128 and the cable 126, and as a result of the cable's motion, also moves filter 130, pulley 122, and pulley 124.

The embodiment of FIG. 10 differs from that of FIG. 9 in that the former embodiment is comprised of a flexible shutter 144 which is hingably attached at points 146 and 148 to the interior surfaces 150 and 152 of filters 128 and 130. As the filters 128 and 130 are caused to move towards each other by the movement of control knob 22, the shutter is compressed.

The flexible shutter 144 is comprised of a multiplicity of light-attenuating segments 154, 156, 158, 160, 162, 164, 168, and 170; it also, in one embodiment, may contain a slit 171 (seen FIG. 11) through which light may pass. The compression of the flexible shutter 144 causes the angle between adjacent light-attenuating segments to decrease. Thus, by way of illustration, as the shutter is compressed angles 172, 174, and 176 are decreased. This compression, and the corresponding decrease in such angles, causes the sections of the flexible shutter to tend to become substantially parallel to ray 34 (seen FIG. 6). When the shutters are substantially parallel to ray 34, they present a smaller barrier to the passage of such ray. On the other hand, when the flexible shutter is expanded, the angles between the shutter sections increase, the shutter sections tend to become substantially perpendicular to ray 34 (seen FIG. 6), and they present a larger barrier to the passage of such ray.

Any of the materials which are so composed and/or constructed so that they allow light to pass through them without changing its spectral composition may be used to construct flexible shutter 144. Thus, by way of illustration, flexible shutter 144 can consist essentially of neutral density materials such as neutral density glass, vapor deposited metals on clear substrate, opaque materials with large or small hole(s) punched in them, and the like.

In one embodiment, flexible shutter 144 is comprised of opaque material. In this embodiment, it is preferred that the opaque material be heat resistant and reflect rather than absorb radiation.

The flexible shutter 144 may be integral, consisting of one piece. Alternatively, it may comprise many pieces.

Referring to FIG. 11, it will be seen that flexible shutter 144 may be comprised of a slit 171 oriented along the longitudinal axis of light source 28. It will be apparent to those skilled in the art that, as flexible shutter 144 is compressed, the length 180 of the slit 171 will decrease, thereby decreasing the opportunity for the light to pass through the shutter. On the other hand, as the flexible shutter 144 is expanded, the length 180 of the slit 171 will increase.

In the preferred embodiment wherein the shutter 144 is comprised of slit 171, the optimum width 184 of the slit 171 may be calculated in accordance with the procedure described below.

The average transmission of filters 128 and 130 is multiplied by the aperture width 182 of aperture 178. The resulting number is a good approximation of the optimum slit width 184 of slit 171, assuming that the maximum length of the slit is equal to the aperture length 180.

There is yet another means of approximating the optimum slit width, even if the transmission of the filters 128 and 130 are unknown. In this second process, a measurement of the irradiance of the viewing plane is taken with filters 128 and 130 fully in place, the irradiance of the viewing plane is taken without the filters 128 and 130 in place, the former irradiance is divided by the latter irradiance, and this quotient is multiplied by the width 182 of the aperture 178, assuming that the maximum slit length is equal to the aperture length 180.

There is yet another means of determining the optimum slit width. The irradiance of the lamp with filters 128 and 130 in place is first determined, then, without such filters in place, the irradiance is adjusted with a shutter with an adjustable slit width so that the irradiance obtained is equal to the irradiance with filters 128 and 130 in place. The slit width thus obtained is the optimum slit width.

If constant irradiance is sought, the measuring device used may be a commercially available radiometer. If constant brightness is desired, the measuring device may be a commercially available photometer. Both of these measuring devices may be obtained, e.g., from International Light Inc., Dexter Industrial Green, Newbury Point, Mass. 01950.

Referring again to FIG. 10, when flexible shutter 144 is compressed, filters 128 and 130 will be pulled toward the center of filter extrusion 44 and thus occupy most of the area of the clear aperture 178 (seen FIG. 11). Thus, although the compression of shutter 144 will tend to allow more of the light through, the movement of the filters 128 and 130 to cover more of the aperture 178 and their ability to modify the spectral output of the light source 28 will correspondingly allow an overall constant amount of light to pass through the aperture 178. Similarly, when the flexible shutter 144 is expanded (and tends to allow less of the light through than an otherwise open aperture), thereby allowing a constant amount of light to pass through the aperture 178.

One feature in common to the embodiment described above is the ability of such devices to simultaneously vary the amount of spectral distribution produced by the device and the flux in such spectral distribution. As is known to those skilled in the art, flux is the time rate flow of energy; it also is the radiant or luminous power in a beam.

It will be apparent to those skilled in the art that many different means may be used to affect the flux and spectral distribution of a light beam. Thus, e.g., one may vary the slit length in a shutter. Thus, e.g., one may use a shutter which does not contain a slit, in which case one may vary the size and/or number of orifices in the shutter.

Thus, e.g., one may cover some or all of the orifices and/or slit(s) in a shutter with attenuating means. Thus, e.g., one may change the configuration of all or part of the shutter assembly vis-a-vis the light beam, thereby affecting the degree to which the light impinges upon the shutter. Many other means of affecting the flux of a light beam will be apparent to those skilled in the art.

Figure 13:
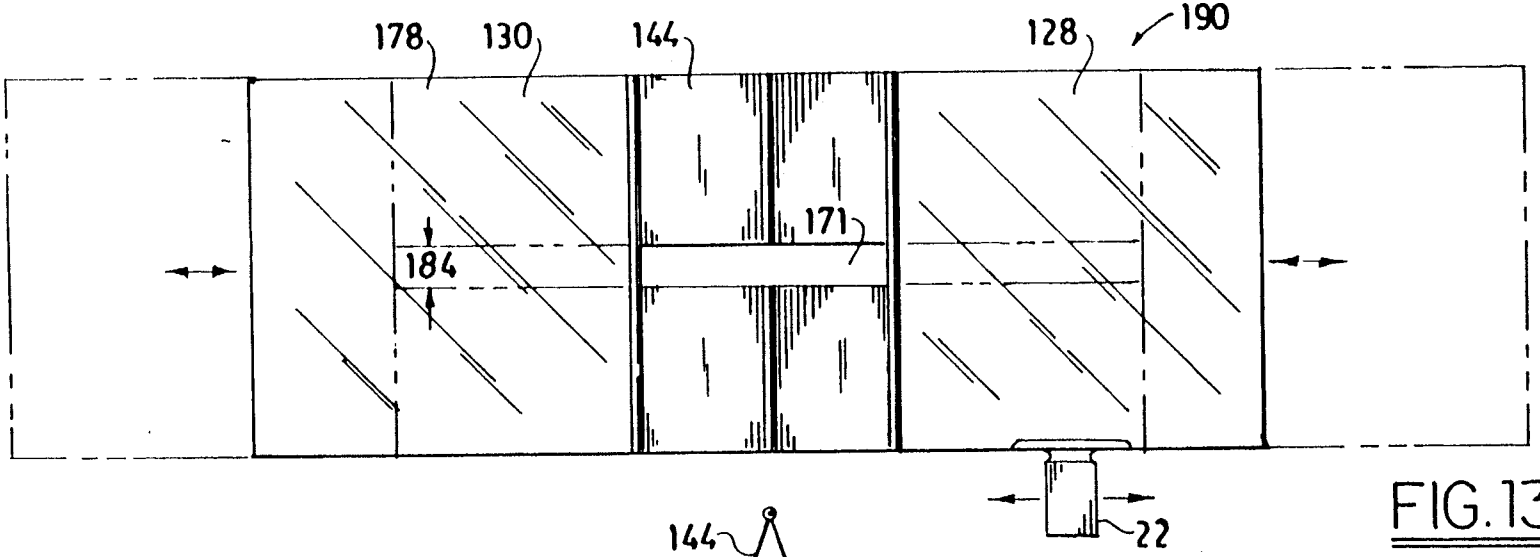
FIG. 13 is a top view of the filter extrusion of FIG. 12.
Figure 12:
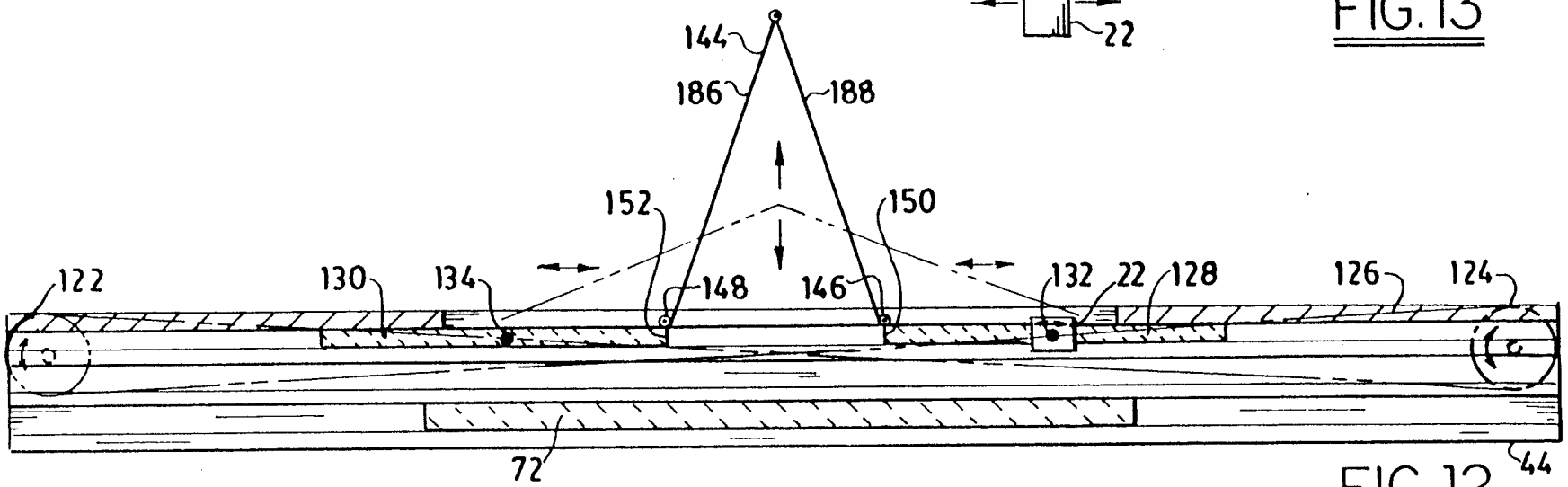
FIG. 12 is a side view of another filter extrusion similar to that depicted in FIG. 8.

FIGS. 12 and 13 describe an embodiment similar to that described in FIGS. 10 and 11 but differing therefrom in the construction of the shutter 144. The shutter apparatus in the device of FIGS. 12 and 13 is comprised of shutter material which may be, e.g., either filter glass and/or opaque material. The shutter is preferably comprised of at least two sections (section 186 and 188), although fewer or more sections also may be used.

In the embodiment (not shown) where only one section is used, the shutter will consist of a material which will be attached at its ends to the movable filter 128.

In the embodiment shown in FIGS. 12 and 13, where the shutter material is comprised of two sections (section 186 and 188), each of these sections is hingably attached at its bottom to either filter 128 or filter 130; shutter section 186 is hingably attached at its bottom to filter 130 (at surface 152) and also is preferably hingably attached at its top to shutter section 188; and shutter section 188 is hingably attached at its bottom to filter 128 (at surface 150) and also is preferably hingably attached at its top to shutter section 186.

It will be apparent to those skilled in the art that the shutter may contain three or more sections of shutter material, which may be the same or different.

In one preferred embodiment, illustrated in FIG. 13, the filter assembly 44 is comprised of a slit 171 which functions in the manner described above. As the shutter assembly 144 is compressed, the length of the slit is compressed, and the shutter is raised into a substantially parallel position vis-a-vis the ray 34. In one preferred embodiment, also illustrated in FIG. 13, the shutter assembly is comprised of filter glass. In another embodiment, not shown, the slit 171 is partially or completely covered with filter glass. In either of these embodiments, the use of a filter glass in the shutter assembly 144 with properties different from the filter glass in filter 128 and/or 130 allows one to adjustably affect the color temperature of the light transmitted through the filter assembly 190. As the shutter is compressed, e.g., the length of the slit 171 decreases, and the amount of light that impinges upon the glass in filters 128 and 130 increases. Conversely, as the shutter is expanded, relatively more light impinges upon the glass in the shutter assembly, and relatively less light impinges upon the glass in filters 128 and 130. Thus, by making a simple adjustment with control knob 22, one may affect the color temperature of the light being produced by apparatus 10.

Applicant's claimed apparatus 10 may be constructed by conventional means using commercially available materials. Thus, by way of illustration and not limitation, the hood 16, the lamp housing 18, and the base 20 may be made out of cold rolled steel with a thickness of 0.047 inches. Thus, e.g., referring to FIG. 6, the lens cover 102 may be made from a sheet of acrylic material with a diamond patter in it which is about 0.125"; it preferably has an ultraviolet light inhibitor in it.

Referring to FIG. 11, the filters 128 and 130 may be made from Hoya LB-120 glass which is 0.150 inches thick×2.150 inches long×2.150 inches wide.

Referring again to FIG. 11, shutter 144 may be made from 0.003" to 0.005" thick aluminum, folded forty times in a corrugated shape, each section being 0.150" long by 2.20" wide with a slit 0.390" wide. In the embodiment shown in this Figure, both the filter and the shutter either jointly or independently cover the entire clear aperture of the light source.

In one embodiment, not shown, the structure of FIGS. 12 and 13 is operatively connected to a control which allows one to increase or decrease the effective slit width 171 of shutter 144. Thus, by varying the slit width and/or the slit length and/or the angle of incidence between the shutter and the light source, one may obtain a substantially infinite number of levels of irradiance for a specified spectral distribution.

In one preferred embodiment, not shown, the filters 128 and 130, and/or the shutter assembly 144, are operatively connected to control knob 22 with a thread and nut system rather than with the pulley and cable system disclosed in the drawings. In the former system, the thread driving one filter also drives second thread in a reverse rotation, via an intermediate coupling, which is in turn attached to a second filter.

Referring to FIGS. 12 and 13, the color correcting glass which may be used to cover slit 171, such filter may be made from Hoya LA-120 glass, which is 0.150 inches thick.

One Preferred Embodiment of the Invention

Figure 14:
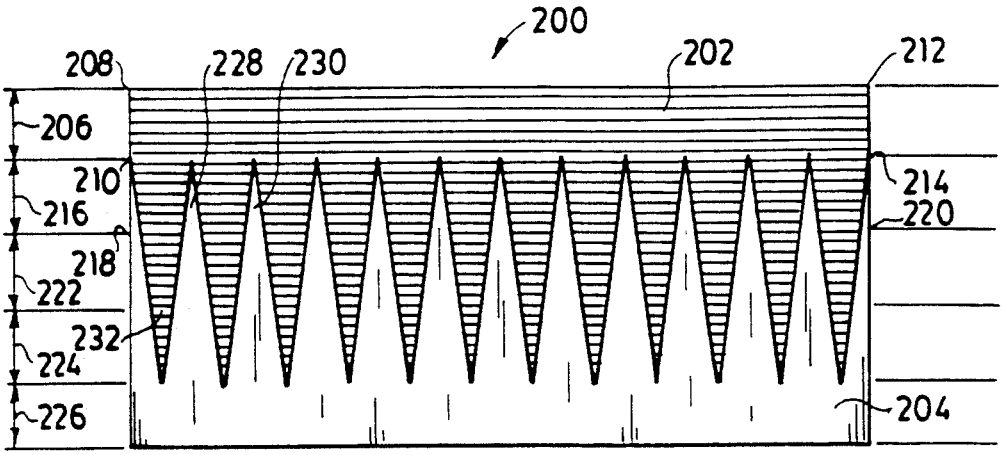
FIG. 14 is a top view of one composite filter used in a preferred embodiment of applicant's apparatus.

FIG. 14 illustrates a composite filter 200 which may be used in one preferred device of applicant's invention. As is known to those skilled in the art, a composite filter is one which is comprised of at least two different filters which have different spectral characteristics.

Referring to FIG. 14, it will be seen that composite filter 200 is comprised of color conversion filter 202 and neutral density filter 204.

As used in this specification, the term color conversion filter refers to a filter that serves to alter the color temperature and the mired value of the radiation emitted by a source. The mired value of the radiation is a function of the color temperature. The reciprocal of the color temperature (1/T) times $10^6$ is equal to the mired value.

Color conversion filters are readily available. Thus, by way of illustration and not limitation, one may purchase color conversion filters from the "Optics Guide 5" (published by Melles Griot Inc. of 1770 Kettering Street, Irvine, Calif., in 1990. By way of further illustration, one may purchase a color conversion filter from Reynard Corporation of 1020 Calle Sombra, San Clemente, Calif.

In one preferred embodiment, the color conversion filter 202 produces a mired shift of from about 5 to about 500 mireds and a spectra with a color temperature of from about 2,000 to about 10,000 degrees Kelvin. In a preferred aspect of this embodiment, the color conversion filter 202 produces a mired shift of from about 100 to about 250 mireds and a spectra with a color temperature of from about 2,500 degrees Kelvin to about 7,500 degrees Kelvin.

Referring again to FIG. 14, it will be seen that composite filter 200 also is comprised of neutral density filter 204. As is known to those skilled in the art, a neutral density filter (also known as a "gray filter") is a light filter that decreases the intensity of the light without altering the relative spectral density of the energy; it has a mired shift of about zero.

Neutral density filters also are readily commercially available. Thus, referring again to the aforementioned "Optics Guide 5," precision metallic neutral density filters are described on pages 11–18 to 11–24.

The optical density of a neutral density filter 204 is the logarithm of the reciprocal of the transmittance of such filter; as is known to those skilled in the art, transmittance is the ratio of the radiant power transmitted by an object to the incident radiant power. It is preferred, in applicant's invention, that neutral density filter 204 have an optical density less than about 2.0 and, more preferably, an optical density of from about 0.4 to about 1.0. It also preferred that color conversion filter 202 have an optical density less than about 2.0 and, more preferably, an optical density of from about 0.4 to about 1.0. The optical density of the color conversion filter 202 is from about 0.9 to about 1.1 times as the optical density of the neutral density filter 204 and, more preferably, such ratio of optical densities is from about 0.95 to about 1.05. In one embodiment, such optical densities are substantially equal.

As will be apparent to those skilled in the art, when an light flux impacts different areas of composite filter 200, different spectral outputs will be produced. However, because the optical densities of filters 202 and 204 are substantially equal, the flux produced in such output will be substantially constant and, consequently, the resulting irradiance or illuminance in a viewing plane will be substantially constant.

Thus, referring again to FIG. 14, when light flux impacts area 206 of filter 200 (which is bounded by points 208, 210, 212, and 214), the light flux will encounter only color conversion filter 202 and will undergo a mired shift dictated solely by the properties of filter 202.

When light flux impacts area 216 of filter 200 (which is bonded by points 210, 218, 214, and 220), it will impact area of both color conversion filter 202 (shown as the shaded portions) and of neutral density filter 204 (shown as the unshaded portions. Because the optical properties of filters 202 and 204 differ, the effect upon the light flux will differ spectrally, depending upon what portion of area 216 the light flux impacts. However, as will be apparent to those skilled in the art, the contribution to the effect upon the light flux will vary depending upon the relative amounts of color conversion filter 202 and neutral density filter 204 impacted by the light flux. As will be apparent to those skilled in the art, as one proceeds within area 216 from point 214 point 220, the relative amount of neutral density filter 204 encountered by the light flux increases, and the relative amount of color conversion filter 202 encountered by the light flux decreases. Thus, as the filter 200 is moved past a particular light source from point 214 to point 220, its spectral output will continuously vary, but the flux density (the flux per unit area) of the spectral output will remain substantially constant.

The same phenomenon will occur as one progresses through areas 222 and 224. In each of these areas, because of the changing geometry of the color conversion filter 204, the relative amount of color conversion filter 204 encountered by the light flux decreases. Finally, when the light flux encounters area 226, it impacts only the neutral density filter.

Thus, as will be apparent to those skilled in the art, the composite filter 200 allows one to continuously vary the spectral distribution of a light source which passes through while maintaining the irradiance of the spectra produced by such filter at a substantially constant level.

Composite filter 200 may be made by conventional means. Thus, for example, one could cut out a section of a color correction filter made out of a plastic material (such as polycarbonate), cut out a complementary section of a neutral density filter, and join the two sections to form the structure of FIG. 14.

In one preferred embodiment, composite filter 200 is an integral structure in which the different filter regions 202 and 204 coated onto a substrate. Thus, for example, one may use as a substrate synthetic fused silica, which is very transparent over a wide spectral range, has a low coefficient of thermal expansion, and is resistant to scratching and thermal shock; see, e.g., page 3-5 of the aforementioned "Optics Guide 5." Alternatively, one may use other suitable transparent materials.

It is preferred to coat both the color converting filter material and the neutral density filter material on the same side of the substrate. The side(s) of the substrate to be coated preferably should be optically smooth.

In the first step of the coating process, the area which the coating is not to adhere to is masked by conventional means, such as with the use of a metal template. Thereafter, the material comprising the color converting filter may be coated onto the substrate.

As is known to those skilled in the art, the color correcting filter material may be applied as a dielectric coating or a metallic coating with a hermetic seal; see, e.g., pages 4-15 through 4-38 of the aforementioned "Optics Guide 5." After the color correcting filter material has been applied, the neutral density filter material is applied after the coated portion of the substrate has been masked.

As is known to those skilled in the art, there are several vendors who will custom make a filter 200 upon being supplied with size, shape, and type of the substrate to be used, the desired geometries of the filter sections 202 and 204, the spectral transmittances of filter sections 202 and 204, and the optical densities of filter sections 202 and 204. One such vendor is the Reynard Corporation discussed elsewhere in this specification.

It will be apparent to those skilled in the art that the particular configuration illustrated in FIG. 14 is but one means of many of continuously varying the spectral output of a light source while maintaining its irradiance at a substantially constant level. Thus, by way of illustration and not limitation, one may coat the optically smooth surface of the substrate with a pattern of dots of color converting filter material and neutral density filter material such that, in a manner similar to that of filter 200, the ratio of the color converting filter material to the neutral density filter material continuously varies as one progresses from section 206 to section 216 to section 222 to section 224 to section 226 of the filter 200. The aforementioned ratio can either increase as one goes in such direction or, alternatively, decrease.

Thus, by way of illustration, one may alter the sawtooth function design illustrated in FIG. 14 so that teeth 228, 230, 232, etc. have different configurations. Thus, for example, such teeth may have arcuate structure.

Many other embodiments which utilize both color converting filter material and neutral density filter material, which utilize a substantially transparent substrate, and in which the ratio of the color converting filter material and the neutral density filter material varies as one goes from one section of the filter to the other, may also be used. As will be apparent to those skilled in the art, the ratio of the color converting filter material to the neutral density filter material will vary from 0 to infinity, as one goes from one section of the filter 200 to another section.

It is preferred, however, that, that the surface area of the color converting filter material in filter 200 be from about 40 to about 60 percent of the total surface area, and the surface area of the neutral density filter material in filter 200 be from about 60 to about 40 percent of the total surface area. In one embodiment, each of filter materials 202 and 204 represent about 50 percent of the total surface area.

As indicated elsewhere in this specification, both filter material 202 and filter material 204 are preferably coated upon the same side of the substrate. The other side of the substrate may be left uncoated. Alternatively, the other side of the substrate may be coated with an anti-reflection coating, a high reflection coating, and the like; see, e.g., pages 4-21 to 4-23, and 4-35 of the aforementioned "Optics Guide 5." One may put a metallic coating on the other side of the substrate; see, e.g., pages 4-28 to 4-30 of "Optics Guide 5." Alternatively, or additionally, the other side of the substrate may have a diffusing characteristic imparted by an irregular surface.

In one embodiment, not shown, the two opposing sides of the substrate, each of which is optically smooth, are each coated with a separate filter material. In this embodiment, the top surface of the substrate may be coated with the color conversion filter material such that, as one progresses from top to bottom, the concentration of the color conversion filter material decreases. Thereafter, the bottom surface of the substrate may be coated with the neutral density filter material such as, as one progresses from top to bottom, the concentration of the neutral density material increases. This technique is described in an article by Forrest Reynard (President of Reynard Enterprises) entitled "Coatings with an F-Number" which was published at pages 13-15 of the June, 1992 issue (Volume 11, Number 6) of "Lasers & Optronics" (published by Gordon Publications, Inc. of 301 Gibralter Drive, Morris Plains, N.J.).

In one embodiment, the other surface of the substrate may be coated with a cold mirror surface which simultaneously increases the illumination of and reduce the heat load of the subject of illumination; see, e.g., page 11-17 of the "Optics Guide 5."

Figure 15:
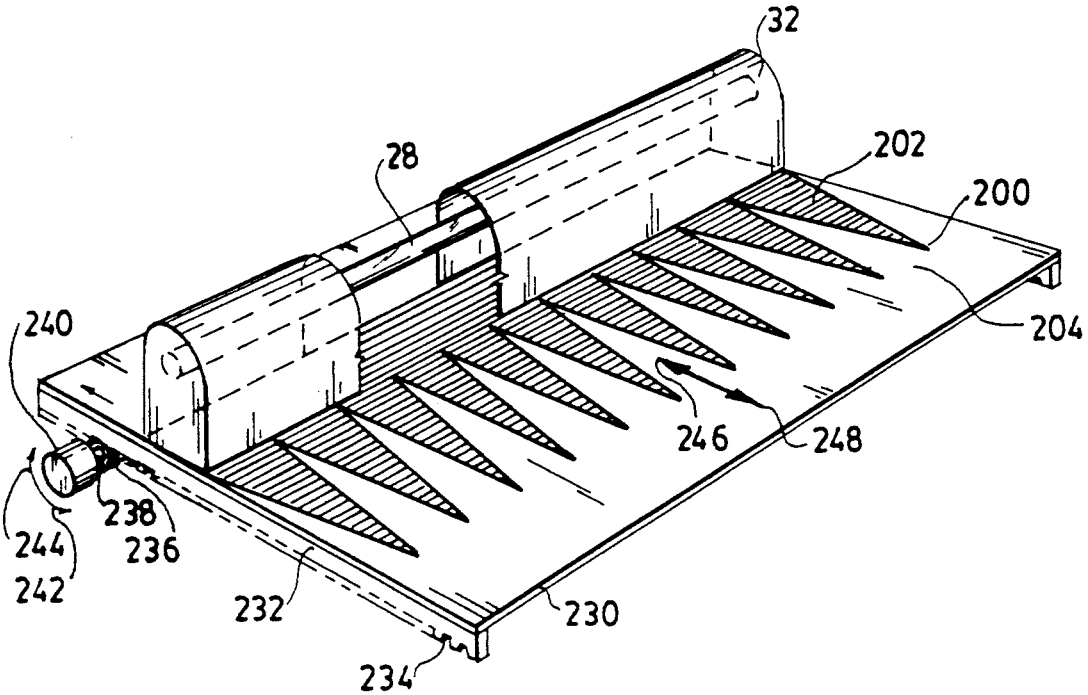
FIG. 15 is a perspective view of a portion of the apparatus of FIG. 14, illustrating the relationship of the filter of FIG. 14 to a light source, a reflector, and a means for moving the composite filter.

FIG. 15 illustrate how composite filter 200 may be used in applicant's device. Referring to FIG. 15, it will be seen that color conversion filter material 202 and neutral density filter material 204 are coated onto substrate 230. The substrate 230, in turn, is mounted on base 232 which is comprised of a multiplicity of teeth 234. A rotatable gear 236 mounted on shaft 238 may be caused to rotate by moving knob 240 in the direction of either arrow 242 or arrow 244, thereby causing the base/substrate assembly to move in the direction of either arrow 246 or arrow 248.

As will be apparent to those skilled in the art, other means of causing the substrate 230/filter 200 assembly to move in the direction of arrow 246 or arrow 248 also may be used. The assembly may be moved manually, by means of a lever, by means a stepper motor, or by other conventional means.

In one embodiment, light source 28 is mounted over filter assembly 200 and preferably enclosed by reflector 32. Thus, the light flux generated at the surface of filter 200 in this device is approximately as wide as the width of reflector 32.

In an alternative embodiment, the reflector 32 will focus light from the light source into a narrow beam and, thus, enable the use of narrower filters.

As the filter 200 is moved past light source 28, the spectral characteristics of the light passing through such filter will continuously vary.

Figure 16:
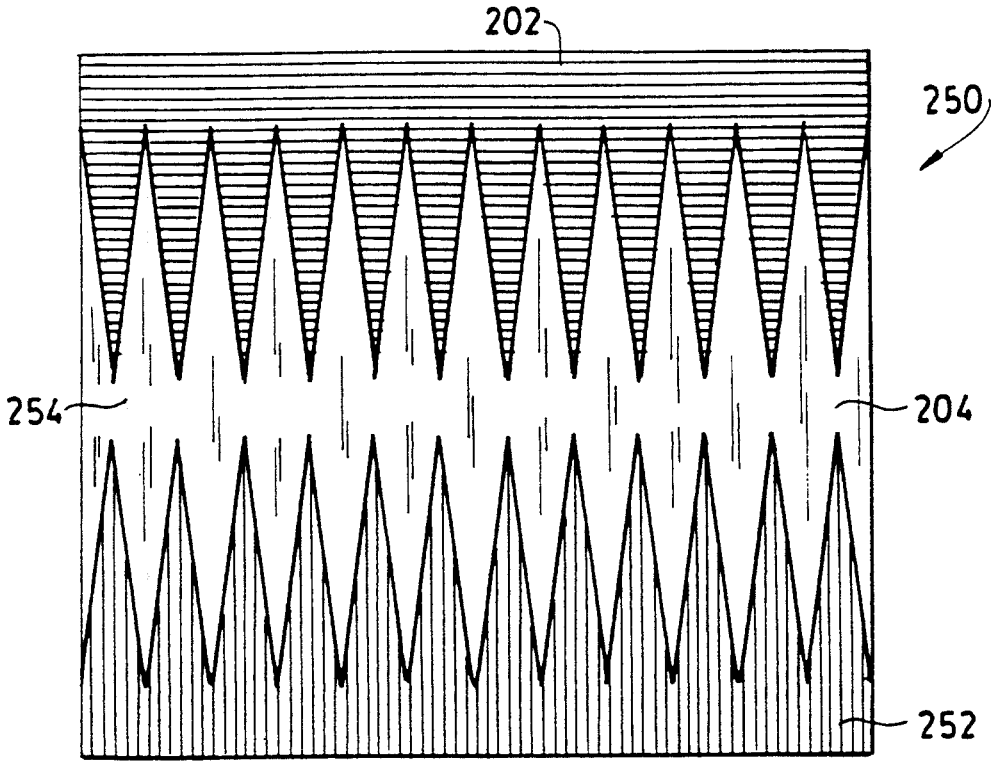
FIG. 16 is a top view of another composite filter used in a preferred embodiment of applicant's invention.

FIG. 16 illustrates a composite filter 250 comprised of color converting filter material 202, color converting filter material 252, and neutral density filter material 204. This Figure illustrates that, in addition to changing the geometry of the filter materials 202 and 204, one may use more than one different filter materials 202, and one may also use several different filter materials 204.

In the embodiment illustrated in FIG. 16, the color converting filter material 202 increases the color temperature of the light from source 28, whereas the color converting filter material 252 decreases the color temperature of such light. Thus, starting from about point, one can either increase the color temperature of such light or decrease, depending upon the direction in which assembly 250 is moved relative to the light source 28.

Figure 17:
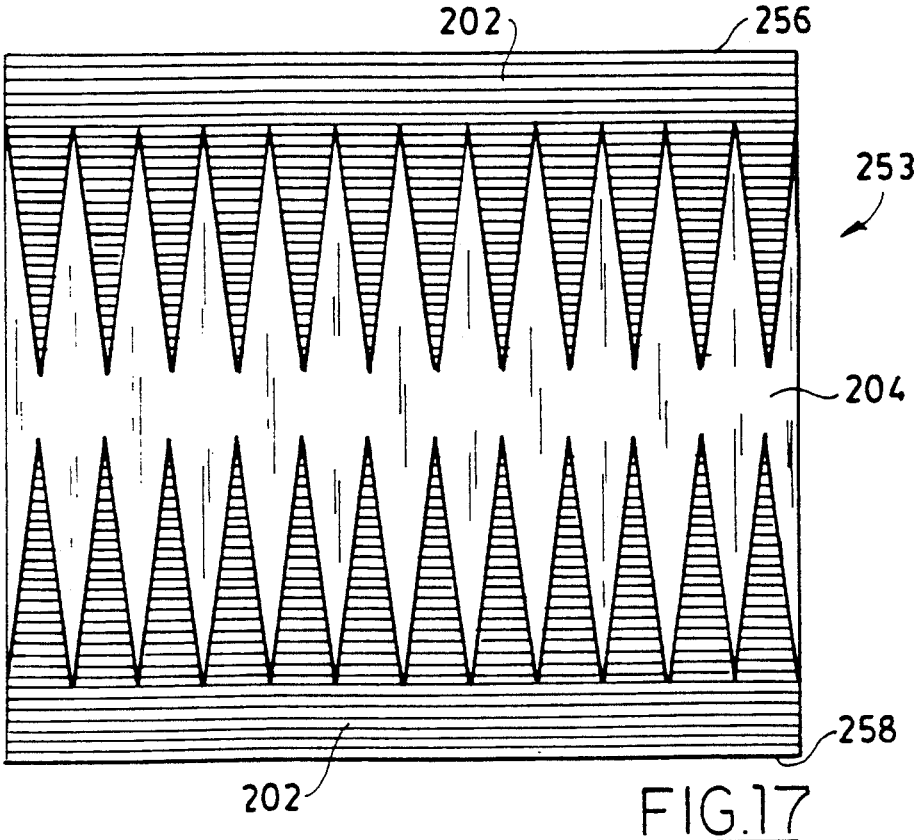
FIG. 17 is a top view of yet another composite filter used in a preferred embodiment of applicant's invention.

FIG. 17 illustrates a composite filter 253 disposed so that its ends 256 and 258 are joined to each other, thereby preferably forming a cylindrical structure.

Figure 18:
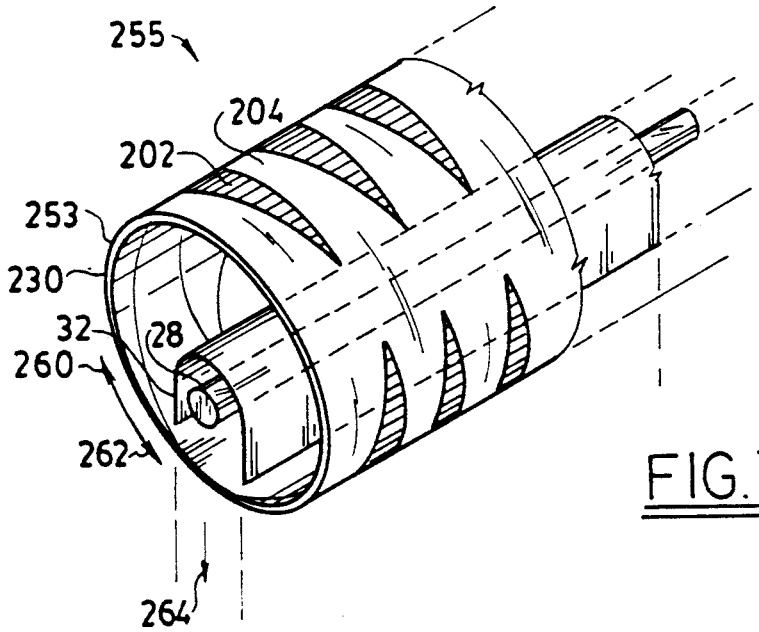
FIG. 18 is a perspective view of a portion of an apparatus comprised of the filter of FIG. 17, showing the relationship of such filter to a light source and a reflector.

FIG. 18 illustrates a cylindrical structure 255 obtained by joining ends 256 and 258, to form a continuous filter surface. As the structure 255 is rotated in the direction of either arrow 260 or 262, the light passing through the filter in the direction of arrow 264 will have a continuously varying spectral distribution.

Figure 19:
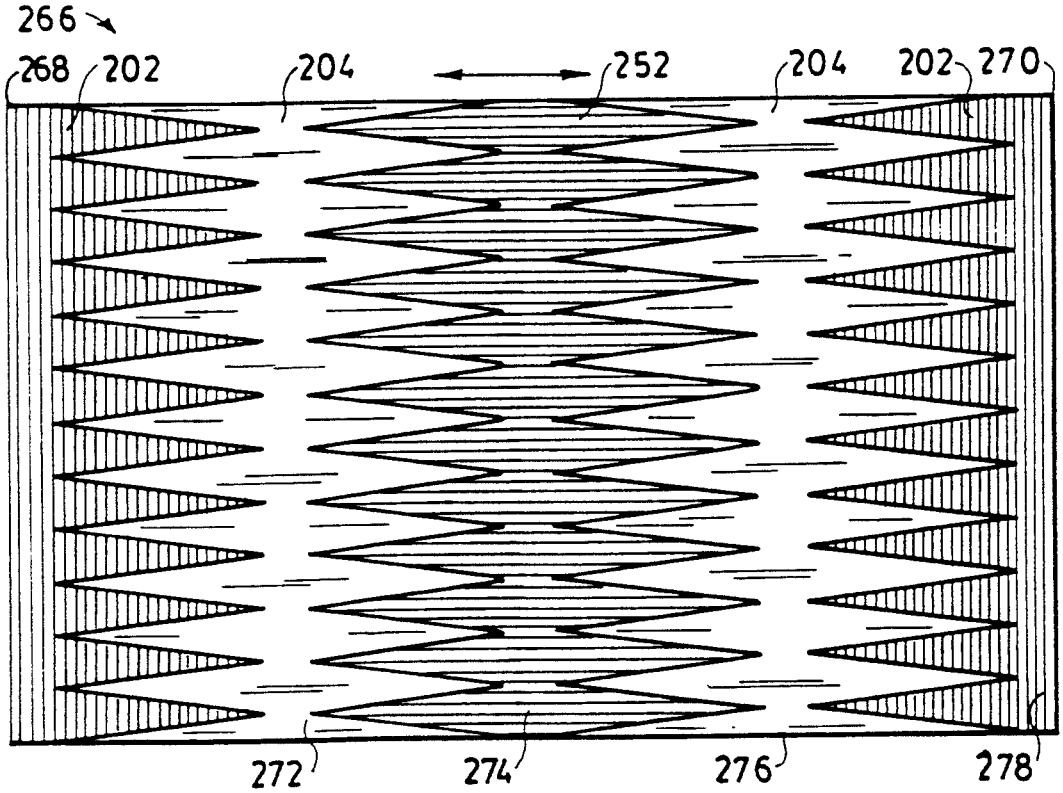
FIG. 19 is a top view of yet another composite filter used in a preferred embodiment of applicant's invention.

FIG. 19 is a top view of a filter 266 which has a composition similar to that of filter 253 (see FIG. 16) but which is joined at ends 268 and 270 to form a circular structure similar to that illustrated in FIG. 18. Referring to FIG. 19, as a light source is caused to impact the filter from point 272 to points 274, 276, and 278, the color temperature of the light passing through the filter first decreases (as it passes through section 252), and then it increases (as it passes through sections 204 and 202).

Figure 20:
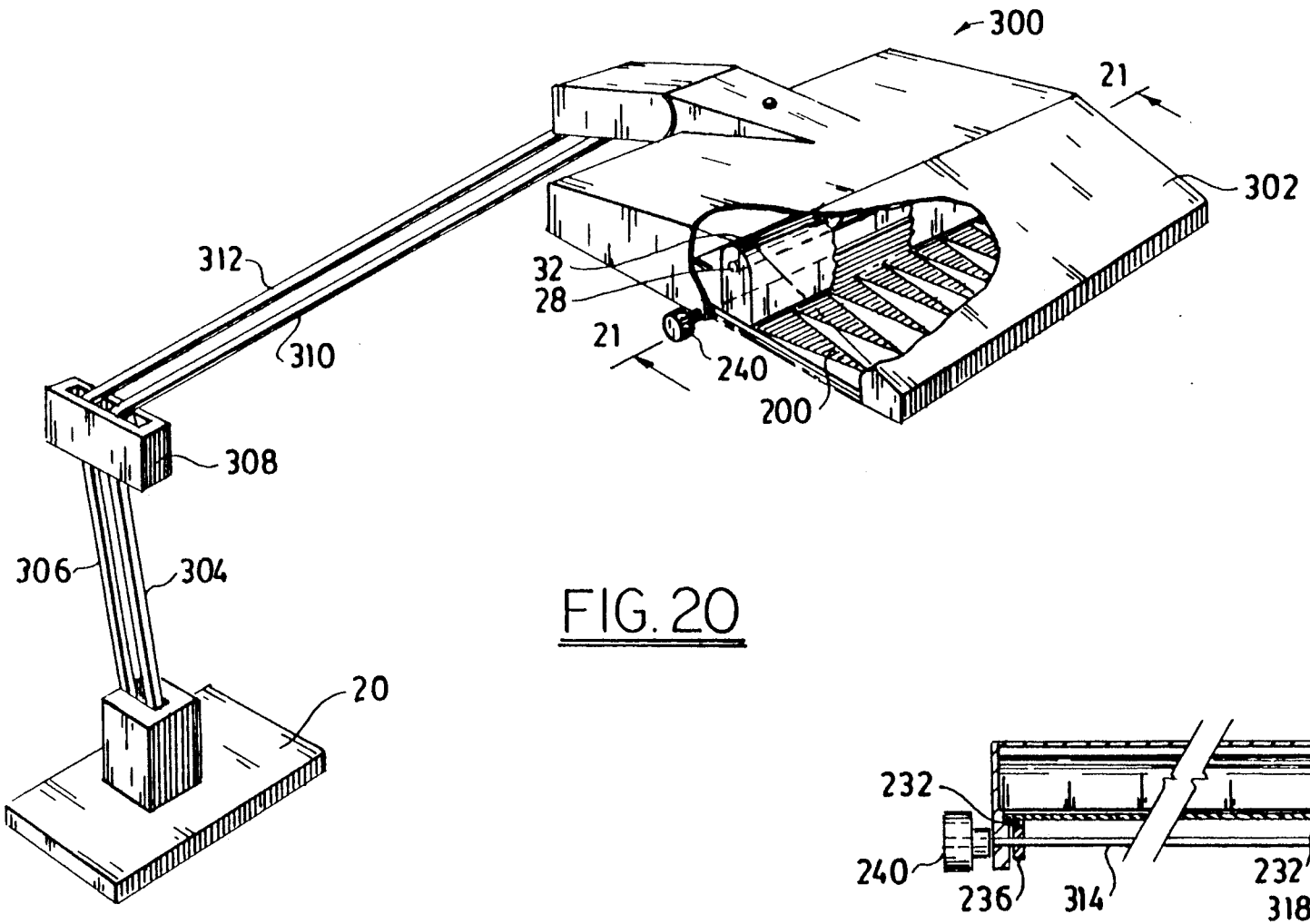
FIG. 20 is a perspective view of one preferred lamp embodying the filter assembly of this invention.

FIG. 20 is a perspective view of another preferred lighting apparatus 300. Referring to FIG. 20, it will be seen that apparatus 300 is comprised of hood 302, base 20, upstanding arms 304 and 306, pivot assembly 308, adjustable arms 310 and 312, filter 200, reflector 32, and light source 28. This apparatus 300 preferably is constructed by disposing the filter assembly depicted in FIG. 15 within a suitable lamp housing, such as the one illustrated in FIG. 20.

The lamp configuration depicted in FIG. 20 is well known to those skilled in the art and may be constructed from readily available commercial materials. See, for example, the lamp configurations illustrated in the "Assymetric Fluorescent Task Lighting Catalog" L-201 published by the Luxo Lamp Corporation of 36 Midland Avenue, Port Chester, N.Y. in 1990. Reference also may be had to Luxo catalog L-203 which also was published in 1990.

As is apparent to those skilled in the art, many different lamp housing configurations may be used with applicant's filter assembly.

Figure 21:
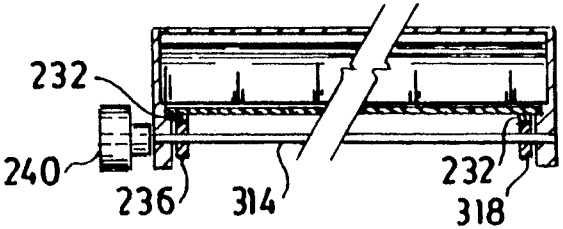
FIG. 21 is a sectional view of the optical assembly portion of the lamp of FIG. 20.

FIG. 21 is a sectional view of the hood 302 of FIG. 20. Referring to FIG. 21, it will be seen that knob 240 is connected to shaft 314. Mounted on shaft 236 are gears 318. The teeth on these gears are contiguous with base 232.

Many other variations will be apparent to those skilled in the art.

Description of Another Preferred Embodiment

Figure 22:
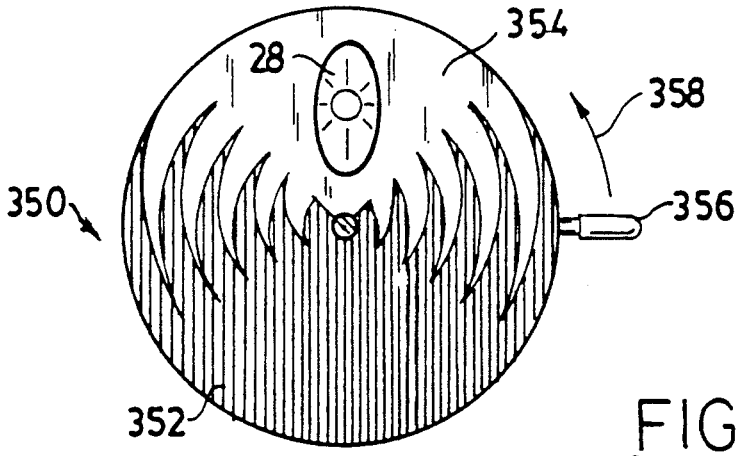
FIG. 22 is a top view of a circular composite filter used in one preferred embodiment of applicant's invention with such filter in its incandescent position.
Figure 23:
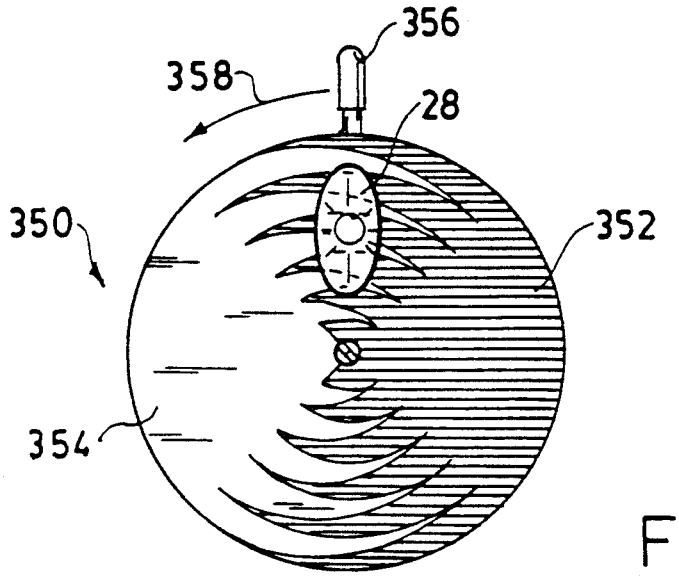
FIG. 23 is a top view of the circular composite filter of FIG. 22 in a position which is between its daylight and roomlight position.
Figure 24:
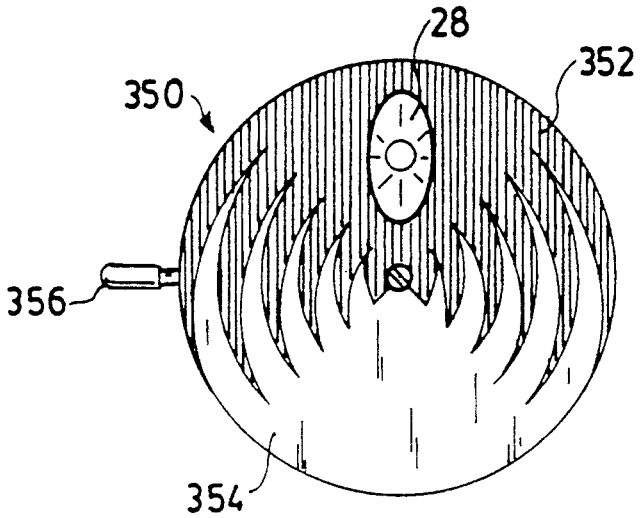
FIG. 24 is a top view of the circular composite filter of FIG. 22 in its daylight position.

FIGS. 22, 23, and 24 illustrate another preferred embodiment in which circular composite filter 350 is utilized.

FIG. 22 is a top view of circular composite filter 350. Referring to FIG. 22, it will be seen that circular composite filter 350 is disposed beneath a light source 28 and is comprised of a color conversion filter 352 and a neutral density filter 354.

It will be appreciated by those skilled in the art that composite filter 350 functions in a manner similar to that of the composite filter 200 illustrated in FIG. 14 and described elsewhere in this specification. In both filter assemblies, the output of the composite filter varies as it is moved relative to the light source 28.

As has been discussed elsewhere in this specification, when a light flux impacts different areas of composite filter 200, or of composite filter 350, different spectral outputs will be produced. However, because the optical densities of filters 202 and 204 (or of filters 352 and 354) are substantially equal, the flux produced in such output will be substantially constant and, consequently, the resulting irradiance or illuminance in a viewing plane will be substantially constant.

Referring again to FIG. 22, and in the preferred embodiment illustrated therein, color conversion filter 352 is preferably integrally connected to neutral density filter 354. In one preferred embodiment, not shown in FIG. 22, a substrate (not shown), such as fused silica, has coated onto one of its surfaces color conversion filter material 352 and neutral density filter material 354; these materials are preferably substantially coplanar and occupy different portions of the surface of the substrate. It will be apparent to those skilled in the art that such materials may be coated onto the substrate in any order by conventional means.

Referring again to FIG. 22, it will be seen that composite filter 350 is preferably comprised of a knob 356 which, as it is rotated in the direction of arrow 358, will present different portions of filter 350 to the light flux (not shown) emanating from lamp 28. As will be apparent to those skilled in the art, each such different portion has different filtering properties, which affect the spectral output of the apparatus. Some of such portions present only neutral density filter material to the light flux (see FIG. 22). Some of such portions present a mixture of neutral density filter material and color conversion filter material to the light flux (see FIG. 23). Some of such portions present only color conversion filter material to the light flux (see FIG. 24). As will be apparent to those skilled in il the art, by moving knob 356 in the direction of arrow 358, a substantially infinite number of combinations of color conversion filter material and neutral density filter material may be presented to the light flux.

The advantage of the embodiment depicted in FIGS. 22, 23, and 24 is that, by continuing to rotate knob 356 in the same direction, one will eventually reproduce the same spectral change pattern by moving the knob to the same position as it occupied 360 degrees ago in a prior cycle.

Figure 25:
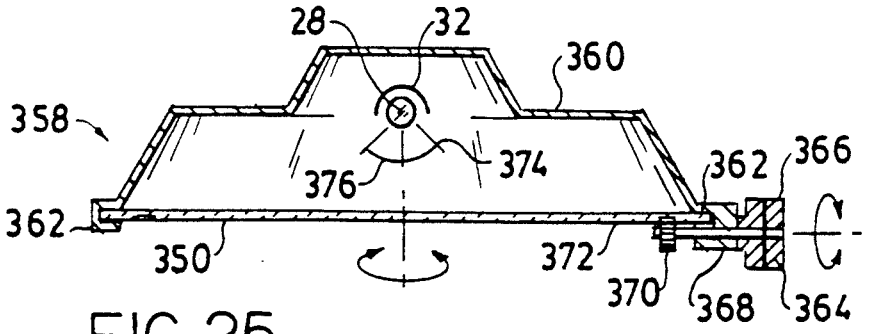
FIG. 25 is a side view of a preferred apparatus comprised of the circular composite filter of FIGS. 22, 23, and 24.

FIG. 25 is a side view of one preferred apparatus 358 which is comprised of composite filter 350. Composite filter 350 is pivotally mounted within hood 360 by conventional means. Thus, by way of illustration, substantially circular composite filter 350 is captured by slot 362 and is free to rotate therein when so moved by assembly 364.

Any conventional assembly may be used to rotate filter 350. Thus, e.g., in the preferred embodiment illustrated in FIG. 25, assembly 364 is comprised of a knob 366, a shaft 368, and a gear 370 communicating with teeth (not shown) in the bottom surface 372 of filter 350. In another embodiment, not shown, shaft 368 is connected to a rubber wheel which abuts the bottom surface 372 of filter 350 and, when shaft 368 is rotated, causes such bottom surface 372 to rotate.

Referring again to FIG. 25, and in the preferred embodiment illustrated therein, it is preferred to dispose light source 28 within a substantially arcuate reflector 32 so that the reflected light will have a relatively narrow cone angle. As is known to those skilled in the art, a cone is a solid figure whose base is a circle and whose sides taper upwardly evenly to a point or apex; light rays diverging from or converging upon a point are sometimes referred to as a cone of light.

In one embodiment, the light rays reflected from reflector 32 preferably form a cone whose angle 376 is less than about 90 degrees.

Referring again to FIG. 25, in one preferred embodiment light source 28 is a direct current, low-voltage bulb.

In one embodiment, not shown, the hood 360 is connected to a shield (not shown) which filters out ambient light from the fine viewing plane.

Figure 26:
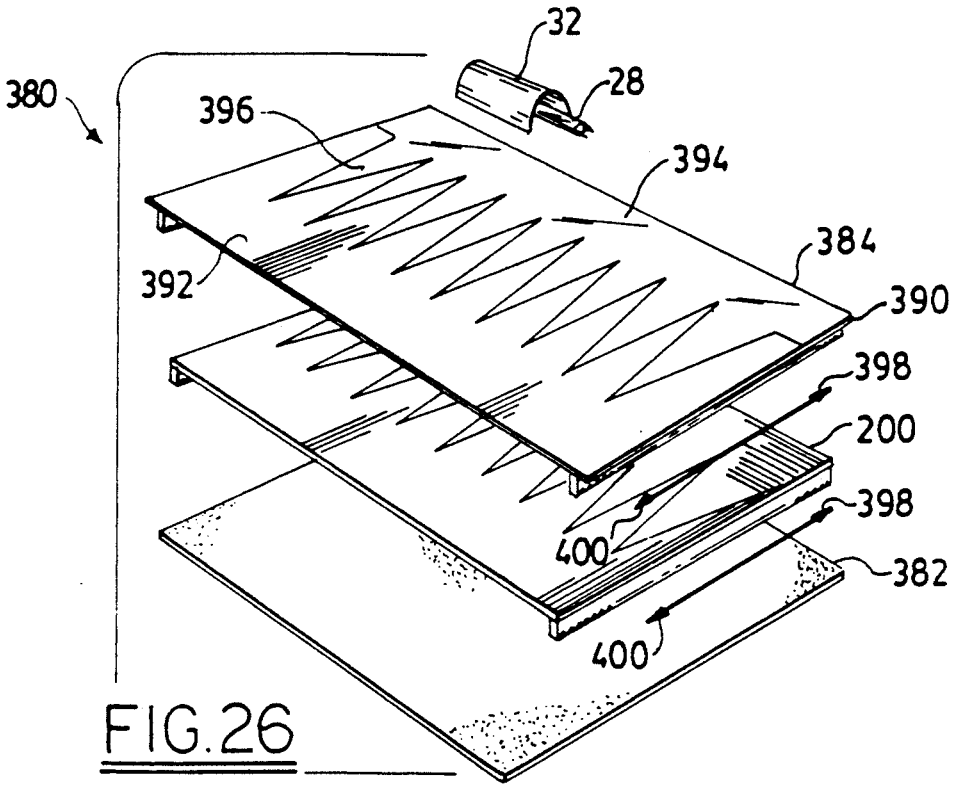
FIG. 26 is an exploded perspective view of another preferred embodiment of applicant's invention which contains a first composite filter, a second composite filter, and a diffuser.

FIG. 26 is an exploded, perspective view of a stacked filter apparatus 380 which is comprised of at least two movable plates, each of which has different optical characteristics and functions. Referring to FIG. 26, it will be seen that stacked filter apparatus 380 is comprised of diffuser 382, composite filter 200 (described elsewhere in this specification by reference to FIG. 14), and a second composite filter 384. The two composite filters are disposed beneath light source 28 whose rays are directed by reflector 32.

The diffuser 382 is adapted to scatter or disperse light emitted from source 28, usually by the process of diffuse transmission. Any of the diffusers known to those skilled in the art may be used in this apparatus. Thus, e.g., one may use such irregular surfaces such as opal glass, bead-blasted glass, frosted glass, frosted translucent plastic, or the like. Thus, e.g., one may use the diffusers described in column 9 of U.S. Pat. No. 5,083,253, the entire disclosure of which is hereby incorporated by reference into this specification.

Referring again to FIG. 26, composite filter 200 is disposed above diffuser 382. In one embodiment, not shown, diffuser 382 is contiguous with composite filter 200, which, in turn, is contiguous with second composite filter 384. In the preferred embodiment illustrated in FIGS. 26 and 27, composite filter 200 is spaced from diffuser 382, and second composite filter 384 is spaced from first composite filter 200. Thus, referring to FIG. 27, "TEFLON" (tetrafluoroethylene) spacers 386 and 388 space these assemblies apart.

Referring again to FIG. 26, as light from light source 28 is reflected downwardly by reflector 32, the light flux will contact an area of second composite filter 384. This second composite filter 384 is comprised of a glass substrate 390 onto which is coated an area 392 of neutral density filter material (described elsewhere in this specification). Depending where second composite filter 384 is disposed with regard to such light source 28, the light flux from light source 28 will encounter either an area of all glass material (such as area 394), an area of all neutral density material (such as area 392), or a an area in which there is both neutral density material and glass (see area 396). Depending upon what type of material is encountered by the light flux, the light transmitted through second composite filter 384 will have different degrees of radiance. Thus, if light source 28 is kept stationary of second composite filter is moved in the direction of either arrow 398 or 400, the irradiance of the light passing through filter 384 may be varied. Alternatively, or additionally, one may move light source 28 and/or reflector 32 to vary the irradiance.

As will be apparent to those skilled in the art regarding this embodiment, even though one may change the irradiance of the light passing through filter 384, its spectral output will remain substantially constant.

As discussed elsewhere in this specification (see the discussion with regard to filter 200 and FIG. 14), as the first composite filter 200 is moved relative to light source 28, the spectral output of light passing through it will vary, but its irradiance will remain substantially constant.

Thus, as will be apparent to those skilled in the art, the apparatus of FIG. 26 provides a first means for varying the spectral output of a light source while maintaining its irradiance substantially constant, and a second means for varying the irradiance of a light source while maintaining its spectral output substantially constant. By independently moving first composite filter 200 and second composite filter 384, one can vary the properties of the light passing through diffuser 382 over a substantially infinite range of conditions.

Figure 27:
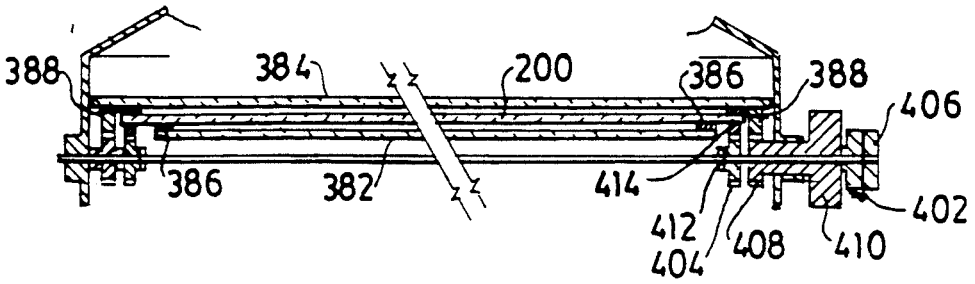
FIG. 27 is a side view of the apparatus of FIG. 26.

One may move either first composite filter 200 and/or the second composite filter 384 in the direction of either arrow 398 and/or 400 by conventional means. Thus, referring to the embodiment depicted in FIG. 27, one may employ an adjustment device 402 which is comprised of an inner shaft 404 attached to knob 406, and an outer shaft 408 attached to knob 410. Referring to FIG. 27, it will be seen that inner shaft 404 is operatively connected to first composite filter 200 by means of rubber wheel 412, and that outer shaft 408 is operatively connected to second composite filter 384 by means of rubber wheel 414. The rotation of either of knobs 406 and 410 will thus cause composite filters 200 and 384 to move back or forth.

Figure 28:
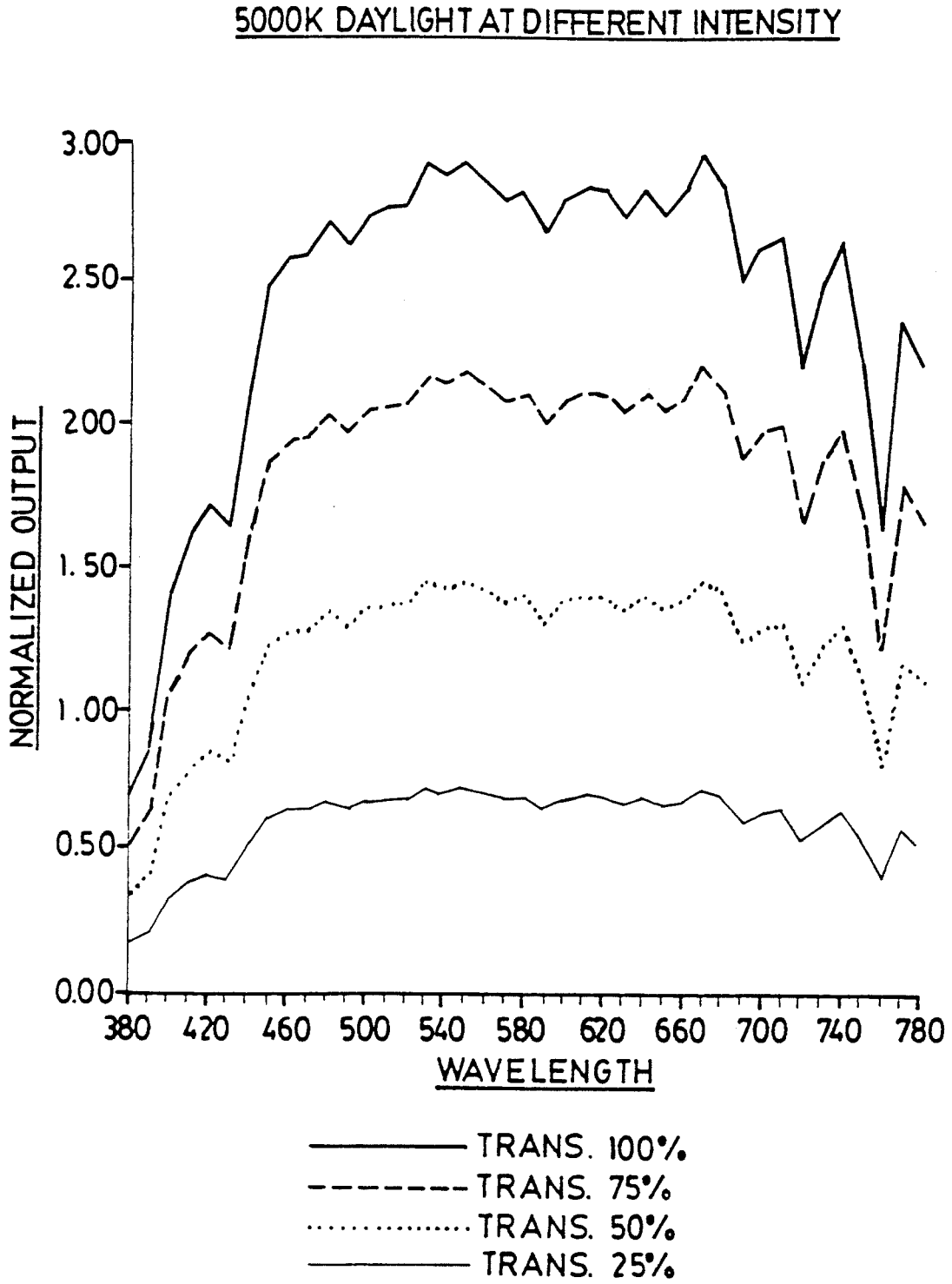
FIG. 28 is a graph of the spectral output of the embodiment of FIG. 27, showing constant spectral output as a function of different light intensities.

FIG. 28 illustrates the spectral output which may be obtained when filter 200 is maintained in one stationary position and filter 384 is moved back or forth. As will be apparent to those skilled in the art, when the flux from light source 28 contacts area 394 of filter 384, the transmission through composite filter 384 is substantially one hundred percent.

In the embodiment illustrated in FIGS. 26 and 27, filters 200 and 384, and diffuser 382 are each substantially rectangular. It will be apparent to those skilled in the art, however, that these elements can have other shapes and undergo other movements in order to vary the irradiance and/or the spectral output of the light flux. Thus, for example, in one embodiment (not shown) each of diffuser 382, first composite filter 200, and second composite filter 384 has a substantially circular cross-section, and each of such elements may separately be rotated (by, e.g., the means illustrated in FIG. 25) in order to vary the spectral output and/or the irradiance of the flux. The shape of the composite filter assemblies and/or the diffuser, and the direction(s) in which they are moved is not critical.

Figure 29:
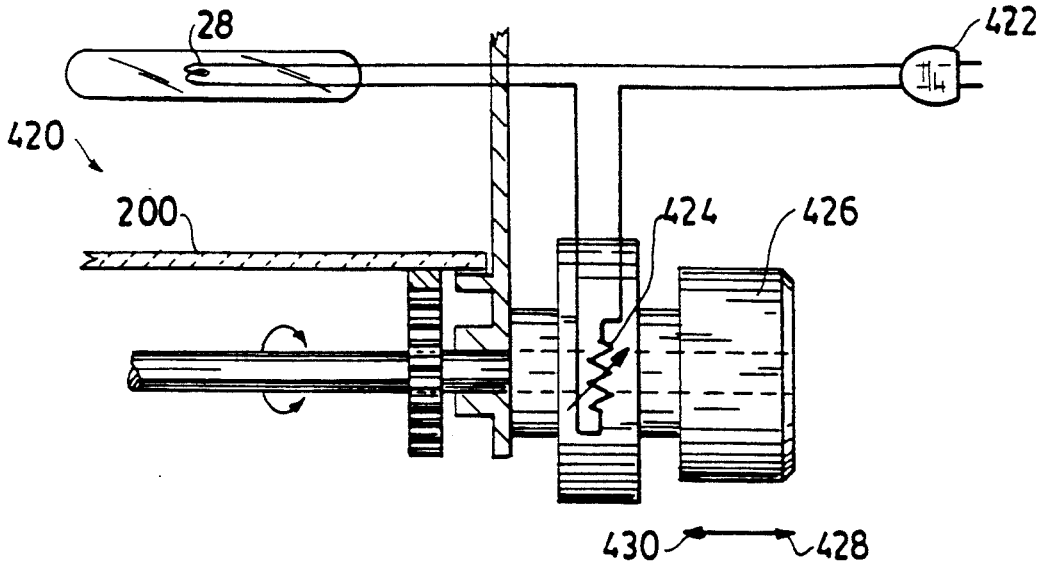
FIG. 29 is a schematic representation of another preferred embodiment of applicant's invention.

FIG. 29 is a schematic representation of an electrical means for providing substantially the same output as is provided by the filter assembly 384 of FIGS. 26 and 27.

Referring to FIG. 29, it will be seen that apparatus 420 is comprised of a source of electrical energy 422 connected to light source 28. The current from electricity source 422 passes through variable resistor 424, whose resistance may be varied by rotating knob 426. As such resistance is varied, the amount of energy delivered to light source 28 will vary.

As the amount of energy delivered to light source 28 varies, the amount of flux emitted from light source 28 and the color temperature also vary. In order to compensate for this variance, and to insure that the spectral output remains substantially constant, the light flux (not shown) is passed through color conversion filter 200.

The position of color conversion filter 200 vise-a-vis light source 28 may be changed by means of knob 426. Thus, as knob 426 is rotated, color conversion filter 200 may be moved laterally in the "Z axis" in and out of the plane defined by the paper. Alternatively, or additionally, knob 426 may be moved in the direction of arrow 428 and/or arrow 430. Depending upon the position of knob 426, and the extent to which it is moved either in or out, the extent to which filter 200 is moved by each revolution of the knob will vary, In one position of the knob 426 (position 430), the gear ratio used to drive the filter 200 back and forth is substantially 1:1. In another position (position 428), the gear ratio is substantially less than 1:1 but is sufficient to offset the color temperature change caused by varying the energy supplied to light source 28. Thus, by varying the position of knob 426, and the extent to which it is rotated, one obtain a substantially constant spectral output with varying intensity (position 428), or a substantially constant intensity with varying spectral output (position 430).

Figure 30:
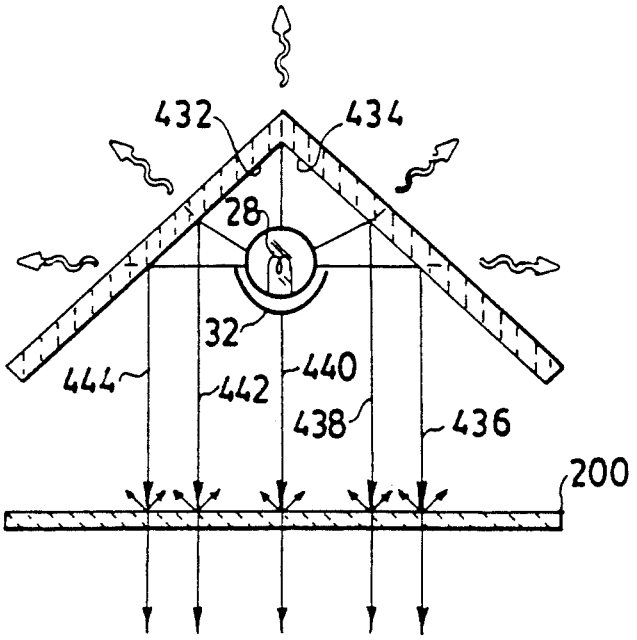
FIG. 30 is schematic representation of yet another preferred embodiment of applicant's invention.

FIG. 30 schematically illustrates one preferred embodiment of the invention in which contains "cold mirror" surfaces 432 and 434.

As is known to those skilled in the art, a cold mirror is a mirror whose coating serves to reflect visible radiation while transmitting the infrared. Such cold mirrors are well known to those skilled in the art and are readily commercially available. Thus, referring to the "Optics Guide 5" catalog (published by Meles Griot, Inc. of 1770 Kettering Street, Irvine, Calif. in 1992), cold mirrors are described and offered for sale on pages 11–16 and 11–17 as, e.g., product numbers 03 MCC 001, 003, 0005, 007, 0009, and 011.

Figure 31:
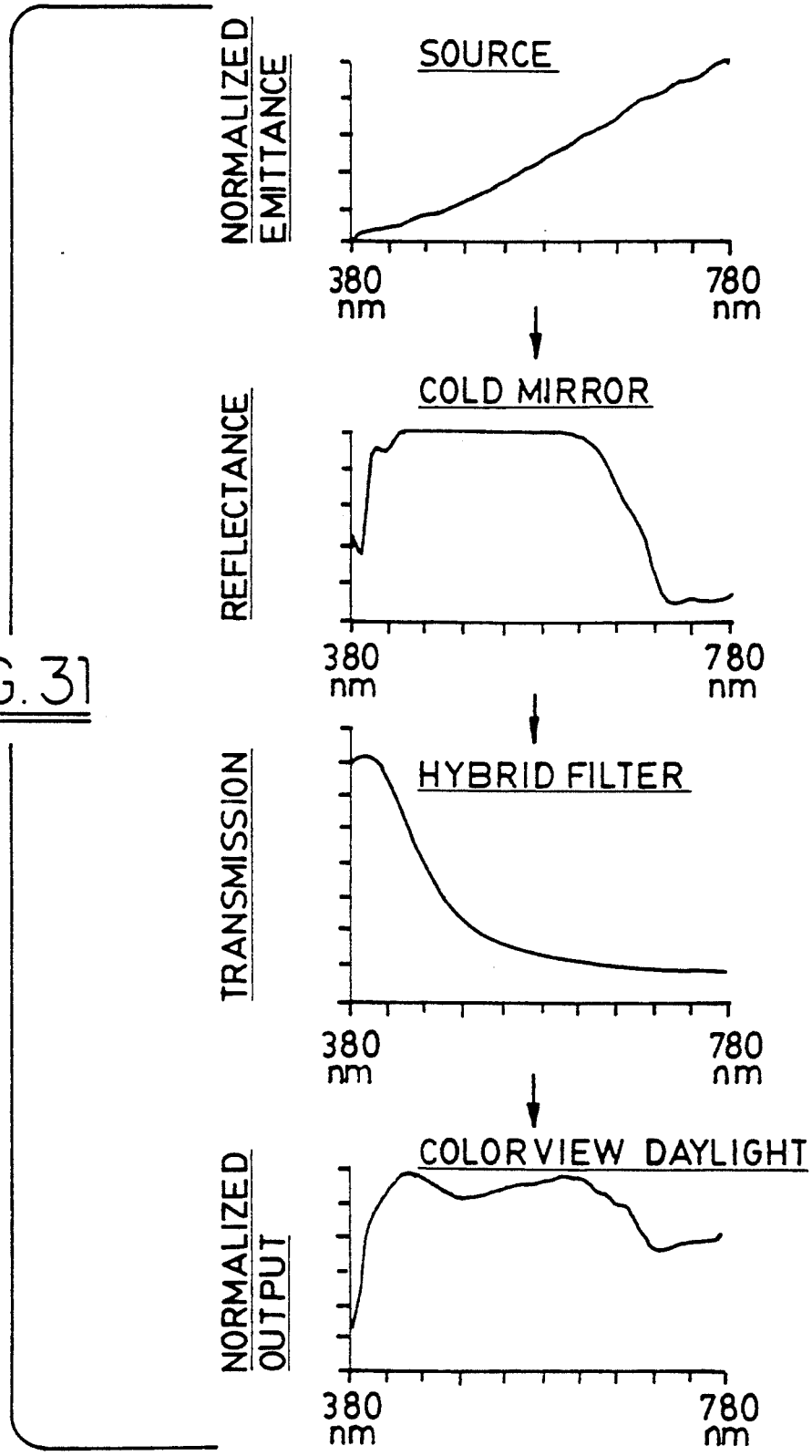
FIG. 31 is a series of graphs illustrating, for the embodiment of FIG. 30, how the spectral output may be modified at various stages of the apparatus.

Referring again to FIG. 30, the light source 28 generates light flux which has a spectral distribution illustrated in FIG. 31 as the "normalized emittance."

The flux from light source 28 is reflected by reflector 32 (which also preferably consists essentially of a cold mirror material). The reflector 32 may be a separate element; alternatively, it may be incorporated into the envelope of the light source 28.

The reflector 32 is so disposed so that some portion of the flux emitted from light source 28 encounters at least one cold mirror surface. In the embodiment illustrated in FIG. 30, about one-half of such flux impacts the cold mirror surface of reflector 32, and the other half of such flux impacts the cold mirror surface of either element 432 or element 434. As will be apparent to those skilled in the art, by the use of other geometries, or dimensions, the amount of flux contacting at least one cold mirror surface pivotally mounted beneath a light source 28 which, in turn, may be varied. In general, however, in this embodiment, it is preferred that at least about fifty percent of the flux generated by light source 28 contact at least one of the cold mirror surfaces.

The effect of the cold mirror surface on the light flux is illustrated in FIG. 31, in the graph identified as "reflectance." That portion of the flux with a wavelength greater than about 780 nanometers is passed through the cold mirror. A substantial portion of the flux with a wavelength less than 780 but greater than about 700 nanometers is also transmitted. Thus, the shape of the graph of the output is substantially varied by contact with the cold mirror.

This property is important because daylight normally does not contain a substantial amount of light with a wavelength greater from about 700 to about 780 nanometers. However, conventional filters often are substantially ineffective at removing a substantial amount of light with a wavelength of from about 700 to about 780 nanometers. The use of the cold mirrors allows one to discard a substantial amount of such light with a wavelength of from about 700 to about 780 nanometers prior to the time the light flux contacts color conversion filter 200.

Referring again to FIG. 30, the color conversion filter will encounter substantially only that light which is reflected from cold mirror 32 and/or cold mirror 432 and/or cold mirror 434. The spectral transmission properties of color conversion filter 200 will be chosen so that, when it encounters light rays 436, 438, 440, 442, 444, etc., it will produce a "colorview daylight" spectrum which is comparable to natural daylight. The use of this arrangement provides a better approximation of natural daylight than any other device known to applicant.

In one embodiment, the color conversion filter 200 may be moved by, e.g., the means illustrated in other portions of this specification to alter the spectral output it produces.

FIGS. 32 through 36 illustrate another preferred embodiment of applicant's invention in which the apparatus 446 is incorporated into a conventional "Tizio Plus" lamp assembly. As is known to those skilled in the art, the "Tizio Plus" lamp is sold by the Artemide Corporation of 1980 New Highway, Farmington, N.Y. 11735.

Figure 32:
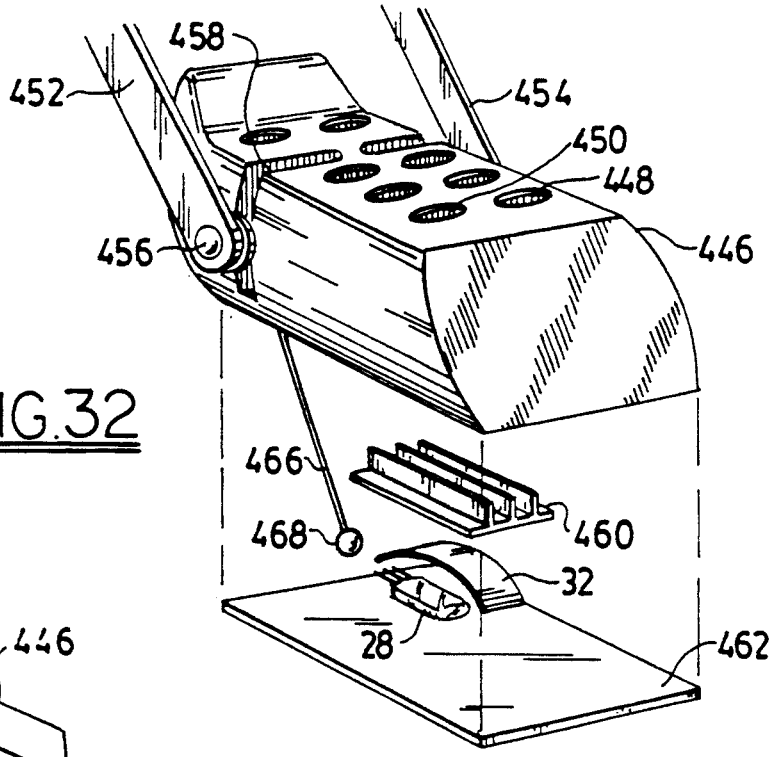
FIG. 32 is an exploded perspective view of another preferred embodiment of applicant's invention.
Figure 33:
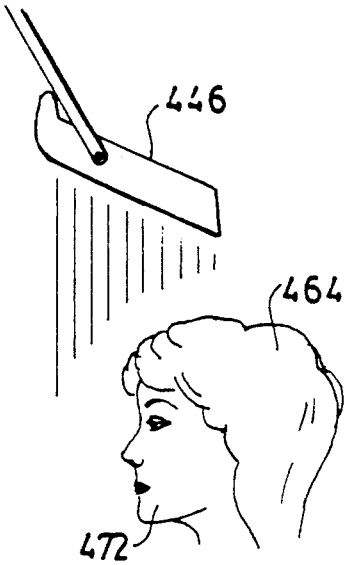
FIGS. 33 and 35 are side views of the embodiment of FIG. 32, disposed at different angles to produce different spectral outputs.
Figure 34:
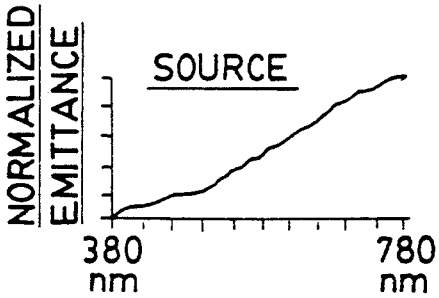
FIGS. 34 and 36 are the spectral outputs of the lamp orientations of FIGS. 33 and 35, respectively.
Figure 35:
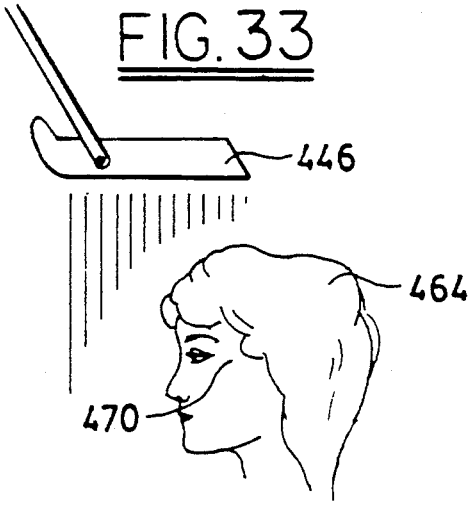
Figure 36:
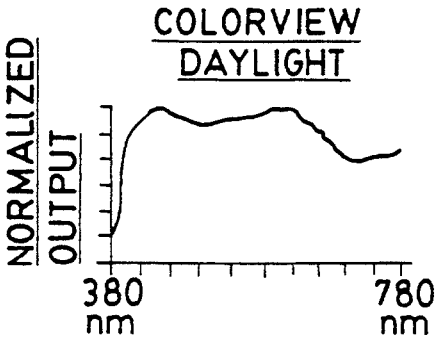

The configuration of the head of the "Tizio Plus" lamp is illustrated in FIG. 32. Referring to FIG. 32, it will be seen that the head 446 of the Tizio Plus lamp is comprised of a multiplicity of orifices 448, 450, etc. to allow heat to escape from such head. Connected to head 446 are arms 452 and 454, which allow the position of head 446 to be adjusted and/or moved. The head 446 is pivotally mounted to arms 452 and 454 by means of fastener 456 disposed within slot 458. Thus, the Tizio lamp may be moved into various positions, as is illustrated in FIGS. 33 and 35.

Referring again to FIG. 32, disposed within the Tizio lamp (not shown) is a light source 28, a cold mirror reflector 32, a heat sink 460, and a color conversion filter 462; this configuration is similar in some respects to the configuration of FIG. 30 and may be used to provide different spectral outputs with substantially the same irradiance.

The spectral output experienced by a viewer depends upon angular relationship between them and the head of the Tizio lamp. Thus, referring to FIG. 33, when the head 446 is in a tilted position vis-a-vis a user 464, such user will perceive the spectral output illustrated in FIG. 34. When, however, the angular disposition of the head 446 is changed to the position depicted in FIG. 35, the user 464 will experience the spectral output of FIG. 36. As will be apparent to those skilled in the art, this phenomenon occurs because color conversion filter 462 is preferably constructed from several layers of dielectric coatings which are sensitive to the angle of incidence of the flux emanating from light source 28.

Referring again to FIG. 32, the head 446 of the Tizio Plus lamp is connected to an adjustment wire 466 which is used to tilt head 446. In one embodiment, wire 466 is attached to a bead 468 which is so disposed that, when it is in the daylight mode of FIG. 35, it will cast a shadow 470 upon a person's temple and, when it is in the incandescent mode of FIG. 33, it will cast a shadow 472 upon a person's chin. Thus, by regulating the degree of tilt and noting where such shadow is cast upon one's face, one may adjust the lamp with a point of reference (the appropriate shadow) until the desired lighting condition is obtained.

It is to be understood that the aforementioned description is illustrative only and that changes can be made in the apparatus, in the ingredients and their proportions, and in the sequence of combinations and process steps, as well as in other aspects of the invention discussed herein, without departing from the scope of the invention as defined in the following claims.

I claim:

1. A apparatus for continuously producing at least two spectrally different light distributions possessing substantially the same irradiance, wherein said apparatus is comprised of a light source for providing light and a adjustable, opto-mechanical filter means for attenuating light from said light source, wherein said adjustable, opto-mechanical filter means is comprised of:

(a) a substantially circular composite filter comprised of a substrate with a top surface and a bottom surface and, contiguous with at least one of said top surface and said bottom surface a first coating of color conversion filter material and a second coating of neutral density filter material; and (b) means for rotating said circular composite filter.

2. The apparatus as recited in claim 1, wherein said coating of color conversion filter material is disposed on said top surface of said substrate.

3. The apparatus as recited in claim 2, wherein said coating of neutral density filter material is disposed on said bottom surface of said substrate.

4. The apparatus as recited in claim 2, wherein said coating of neutral density filter material is disposed on said top surface of said substrate.

5. The apparatus as recited in claim 4, wherein:

(a) said first coating of color conversion filter material is disposed on a first portion of said top surface of said substrate, (b) said second coating of neutral density filter material is disposed on a second portion of said top surface of said substrate, (c) said first coating of color conversion material and said second coating of neutral density material are substantially coplanar, and (d) substantially all of said top surface is contiguous with a material selected from the group consisting of said first coating of color conversion material, said second coating of neutral density material, and mixtures thereof.

6. The apparatus as recited in claim 5, wherein each of said first portion of said top surface and said second portion of said top surface have an irregular cross-section.

7. The apparatus as recited in claim 6, wherein a diffuser material is contiguous with said bottom layer of said substrate.

8. The apparatus as recited in claim 7, wherein said second coating of neutral density filter material is a hermetically sealed metallic coating.

9. The apparatus as recited in claim 8, wherein said first coating of color conversion filter material consists essentially of dielectric material.

10. The apparatus as recited in claim 9, wherein said substrate is comprised of fused silica.

11. A apparatus for continuously producing at least two spectrally different light distributions possessing substantially the same irradiance, wherein said apparatus is comprised of a light source for providing light and a adjustable, opto-mechanical filter means for attenuating light from said light source, wherein said adjustable, opto-mechanical filter means is comprised of:

(a) a first composite filter disposed beneath said light source, wherein:

1. said first composite filter is comprised of a substrate with a top surface and a bottom surface and, contiguous with at least one of said top surface and said bottom surface, a coating of neutral density filter material;

(b) a second composite filter comprised of a color conversion filter and a neutral density filter, wherein said second composite filter is disposed below said first composite filter;

(c) first means for moving said first composite filter; and (d) second means for moving said second composite filter.

12. The apparatus as recited in claim 11, wherein said coating of neutral density material appears on a first portion of said top surface of said substrate.

13. The apparatus as recited in claim 12, wherein said top surface of said substrate consists essentially of said first portion of said substrate and an uncoated second portion.

14. The apparatus as recited in claim 13, wherein said substrate consists essentially of fused silica.

* * * * *